US010100850B1

(12) United States Patent
Raymond

(10) Patent No.: US 10,100,850 B1
(45) Date of Patent: Oct. 16, 2018

(54) MODULAR FLUID POWERED LINEAR PISTON MOTORS WITH HARMONIC COUPLING

(71) Applicant: National Technology & Engineering Solutions of Sandia, LLC, Albuquerque, NM (US)

(72) Inventor: David W. Raymond, Edgewood, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 248 days.

(21) Appl. No.: 15/090,282

(22) Filed: Apr. 4, 2016

Related U.S. Application Data

(63) Continuation-in-part of application No. 14/209,840, filed on Mar. 13, 2014, now Pat. No. 9,447,798, which is a continuation-in-part of application No. 14/198,377, filed on Mar. 5, 2014, now abandoned.

(60) Provisional application No. 62/142,837, filed on Apr. 3, 2015, provisional application No. 61/785,539, filed on Mar. 14, 2013.

(51) Int. Cl.

| | |
|---|---|
| ***F15B 15/02*** | (2006.01) |
| ***F01B 1/00*** | (2006.01) |
| ***F01B 11/04*** | (2006.01) |
| ***E21B 4/14*** | (2006.01) |
| *B06B 1/18* | (2006.01) |

(52) U.S. Cl.
CPC ..... *F15B 15/02* (2013.01); *E21B 4/14* (2013.01); *F01B 1/00* (2013.01); *F01B 11/04* (2013.01); *B06B 1/183* (2013.01)

(58) Field of Classification Search
CPC ..... F15B 15/02; F15B 15/068; F15B 15/063
See application file for complete search history.

(56) References Cited

U.S. PATENT DOCUMENTS

| | | | | |
|---|---|---|---|---|
| 1,413,499 | A | 4/1922 | Smith | |
| 2,051,839 | A | 8/1936 | Gartin | |
| 2,081,919 | A * | 6/1937 | Gartin | E21B 21/01 173/78 |
| 3,059,619 | A | 10/1962 | Beaumont | |
| 3,612,191 | A | 10/1971 | Martini | |
| 3,766,831 | A | 10/1973 | Yeakley | |
| 5,634,390 | A * | 6/1997 | Takeuchi | F15B 15/061 74/424.73 |
| 6,609,577 | B2 | 8/2003 | Beccu | |
| 6,742,605 | B2 | 6/2004 | Martini | |
| 7,416,034 | B2 | 8/2008 | Downie | |

* cited by examiner

*Primary Examiner* — Thomas E Lazo
(74) *Attorney, Agent, or Firm* — Daniel J. Jenkins

(57) ABSTRACT

A modular motor is disclosed that includes a piston/harmonic drive assembly that is axially cycled. The piston/harmonic drive assembly is coupled to a ball transfer arrangement that converts the axial motion into rotary motion to rotate a rotor that can be used to rotate a drill bit.

20 Claims, 27 Drawing Sheets

Module A – "Isolated" or "Closed" Power Section Module.

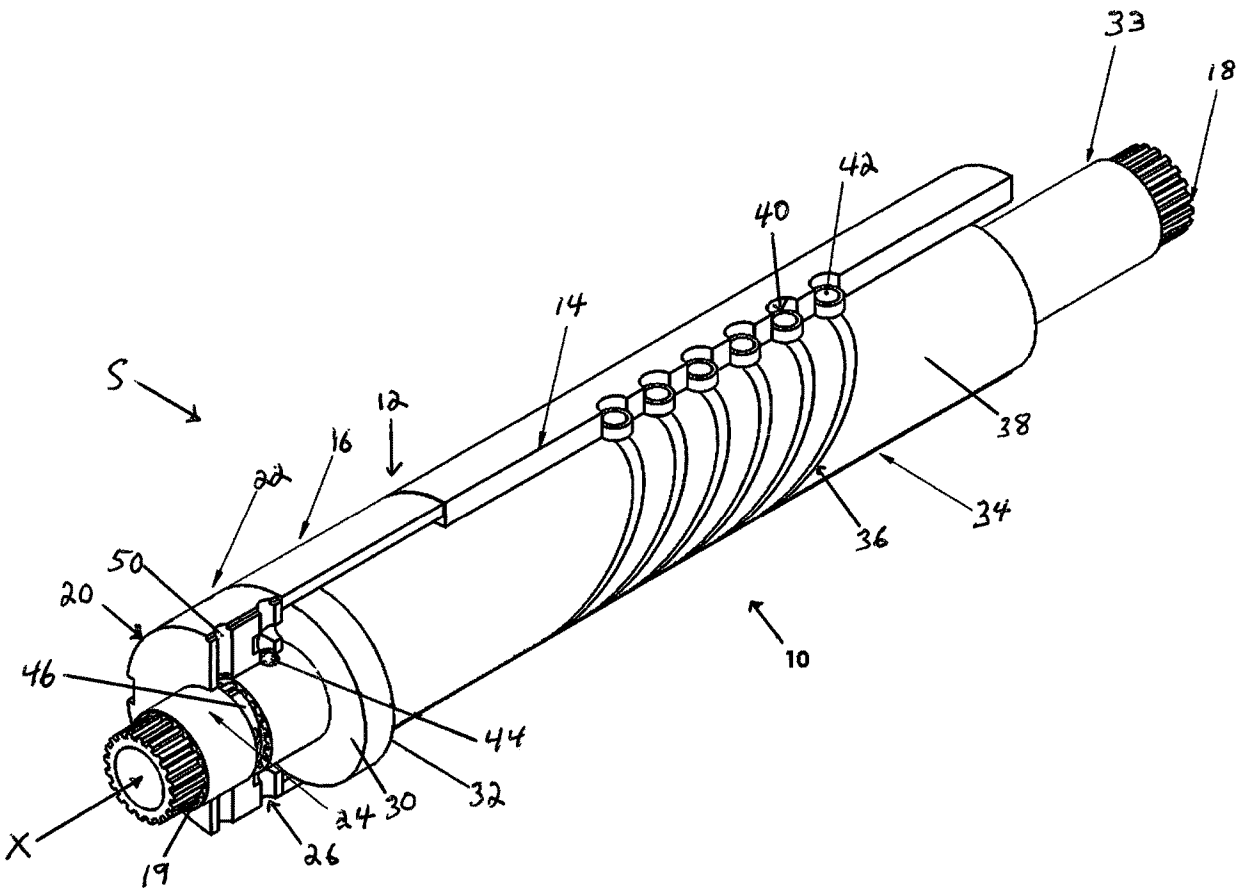
Figure 1 – Module A – "Isolated" or "Closed" Power Section Module.

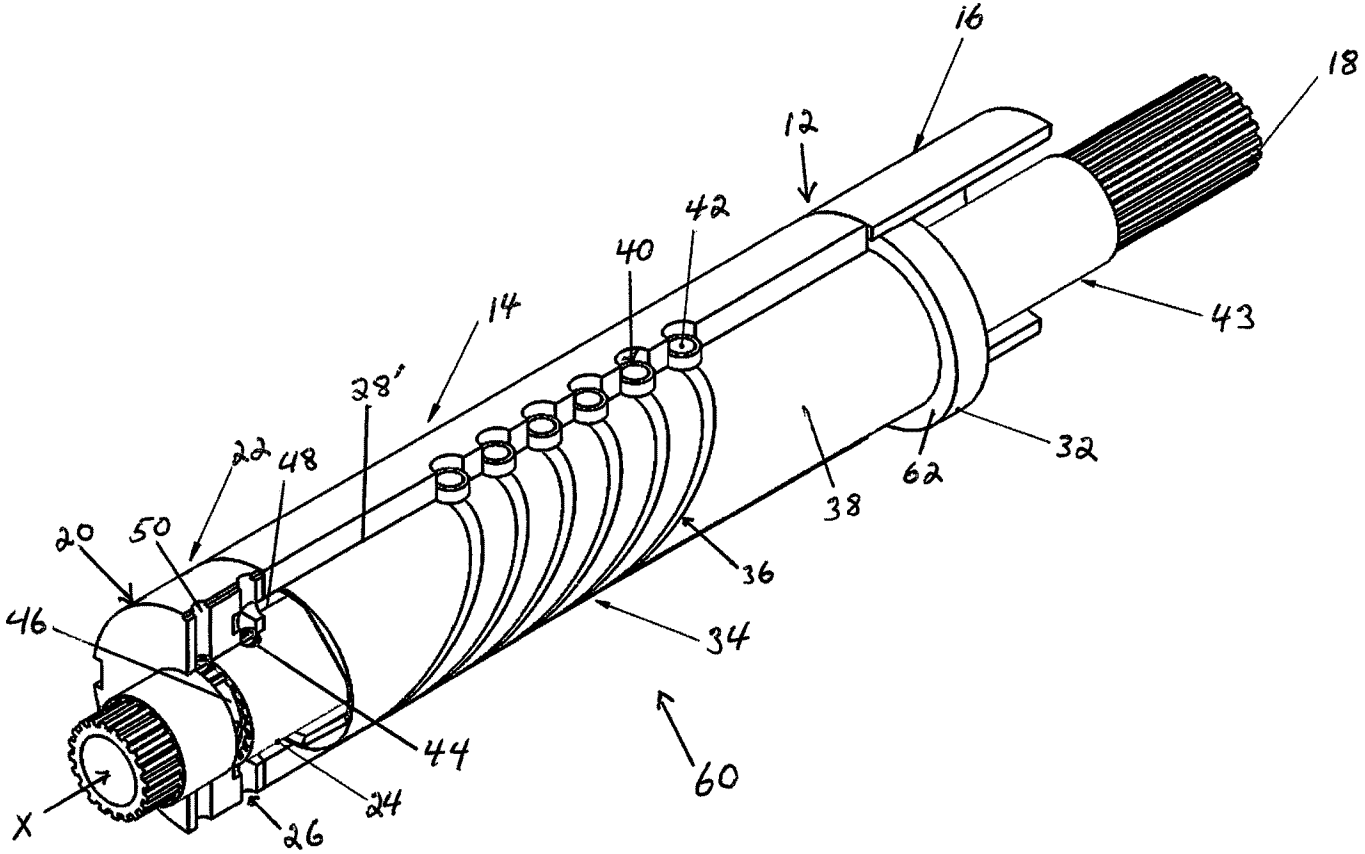
Figure 2 – Module B – "Open" Power Section Module.

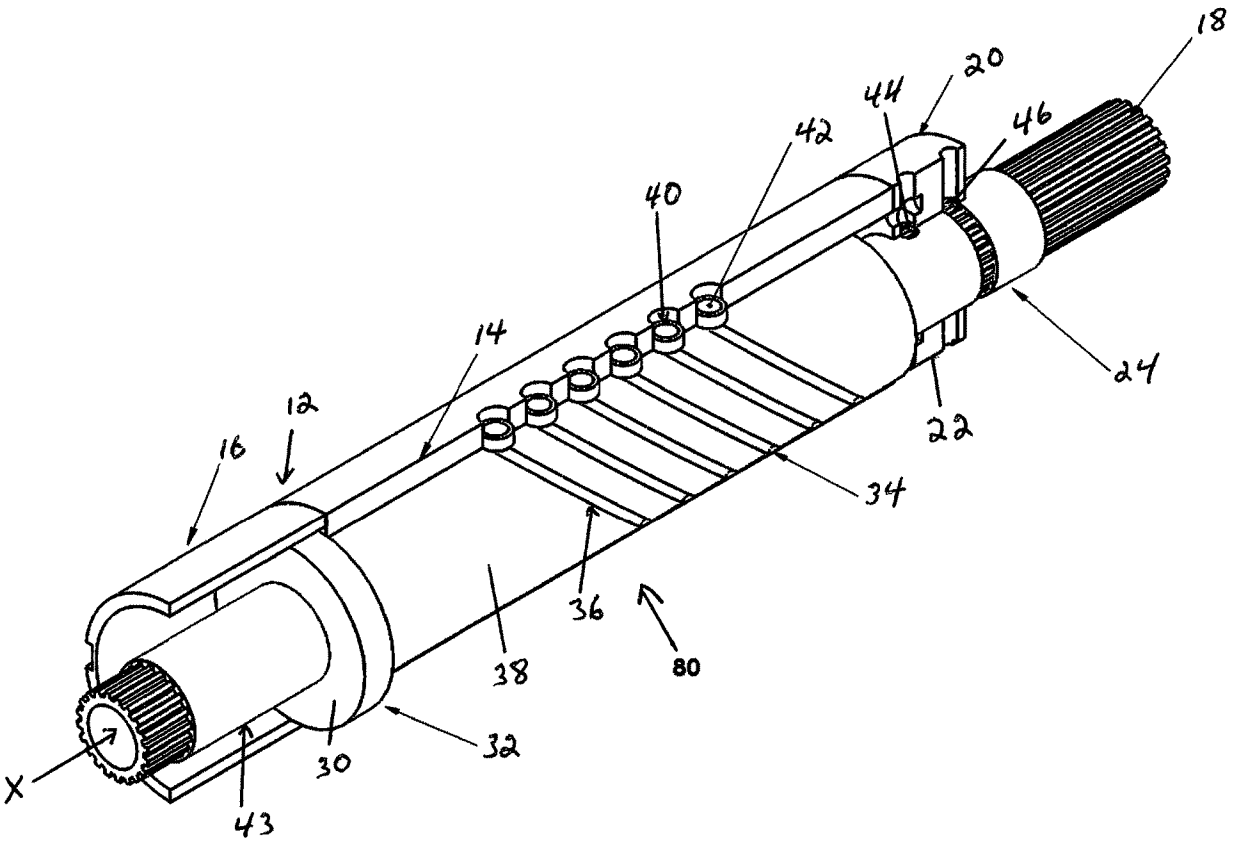
Figure 3 – Module B' – "Open" Power Section Module.

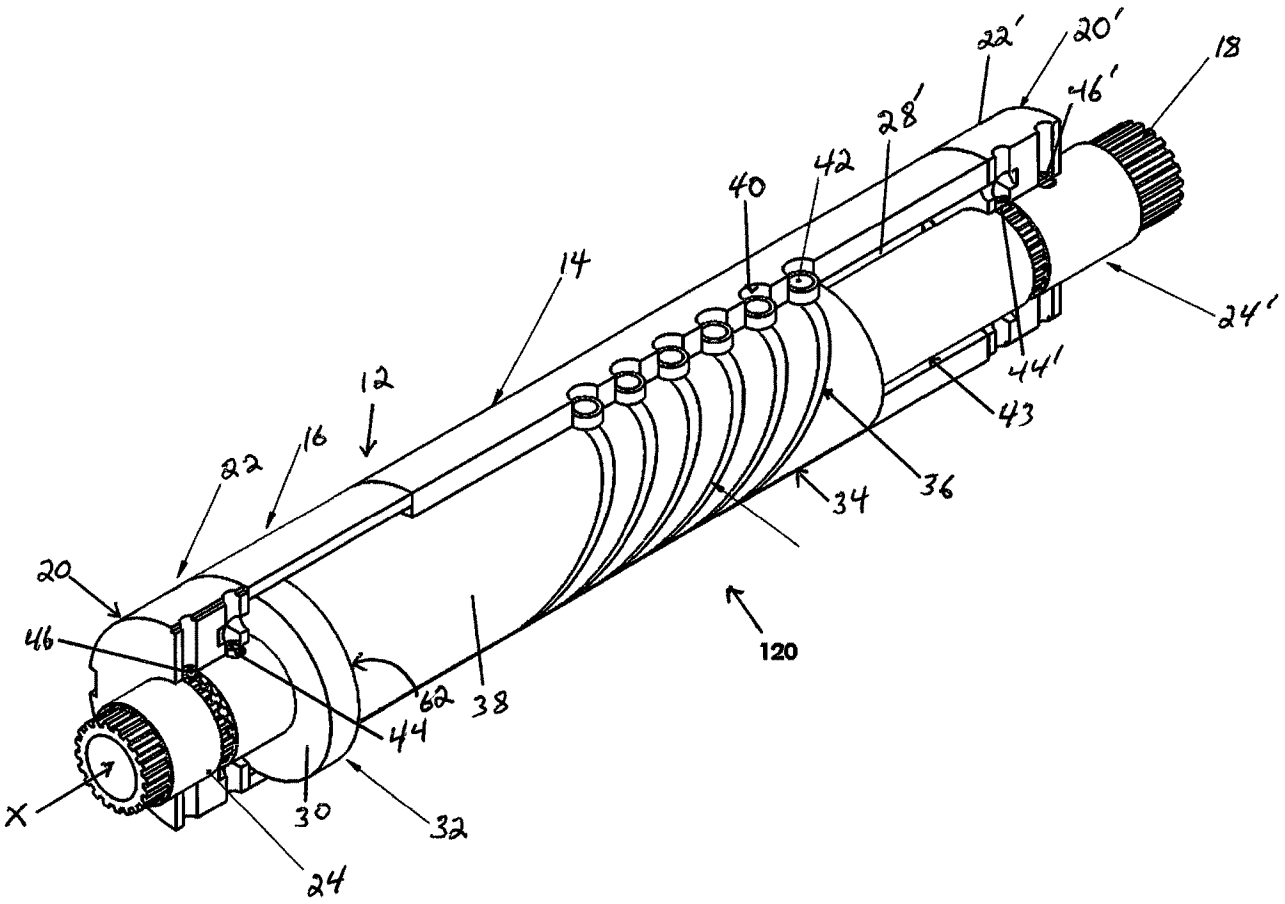
Figure 4 – Module AB'.

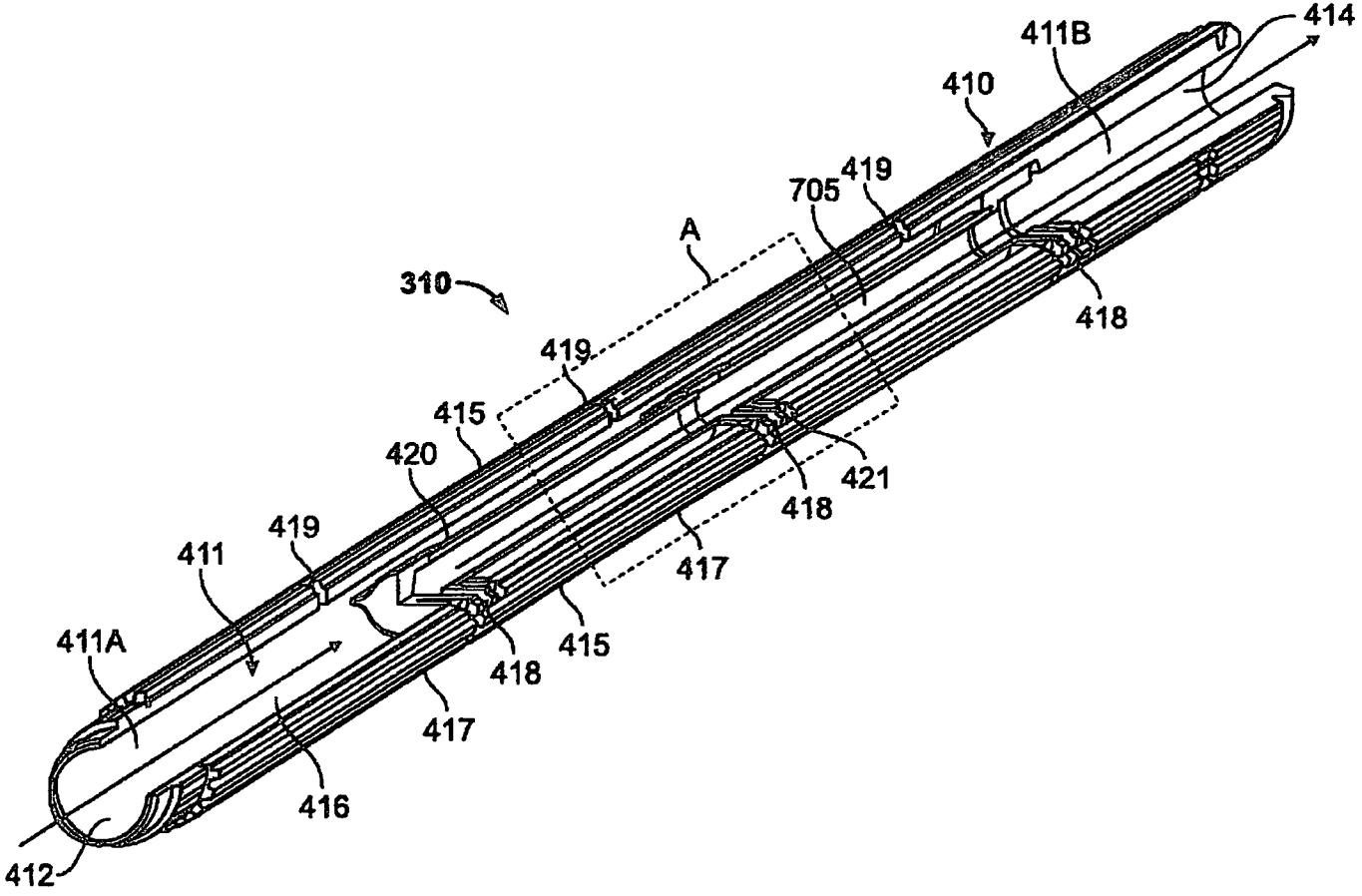
Figure 9 – Rotor Cut-Away.

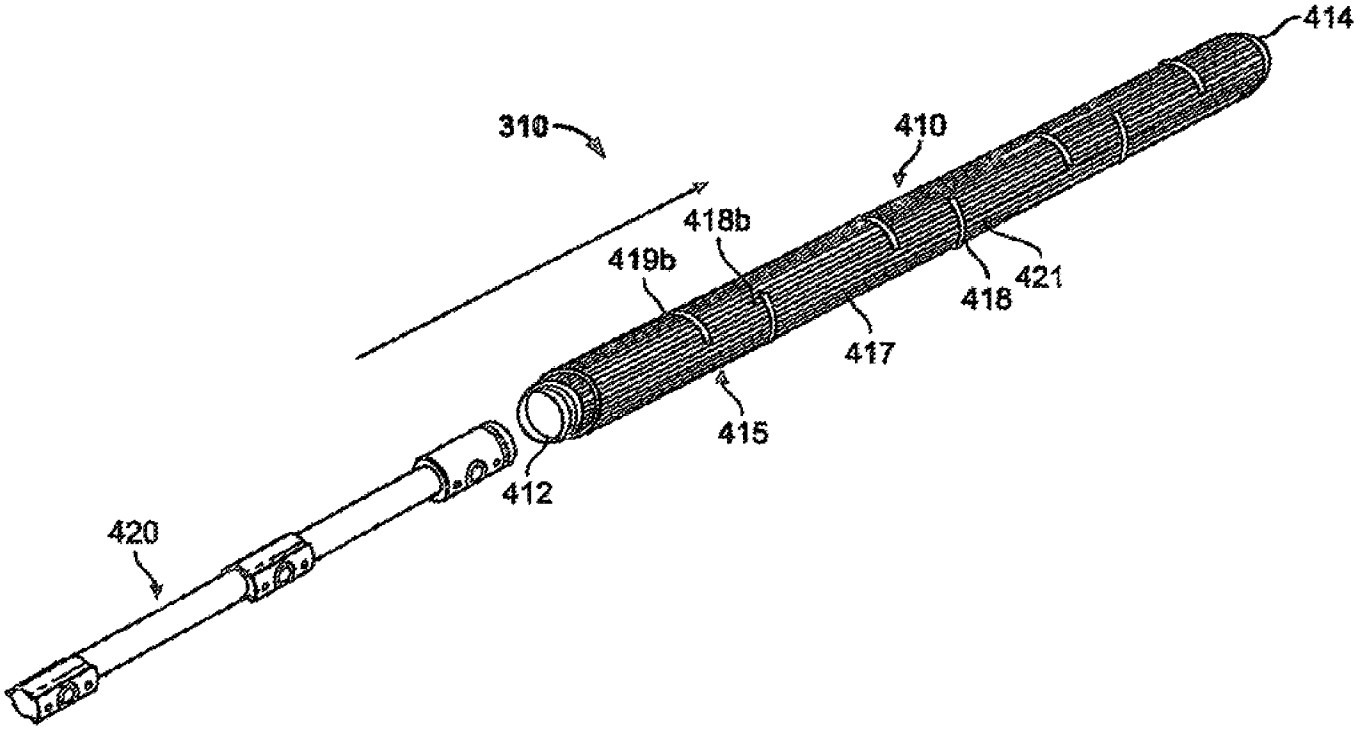
Figure 10 – Exploded View of Inner and Outer Rotor.

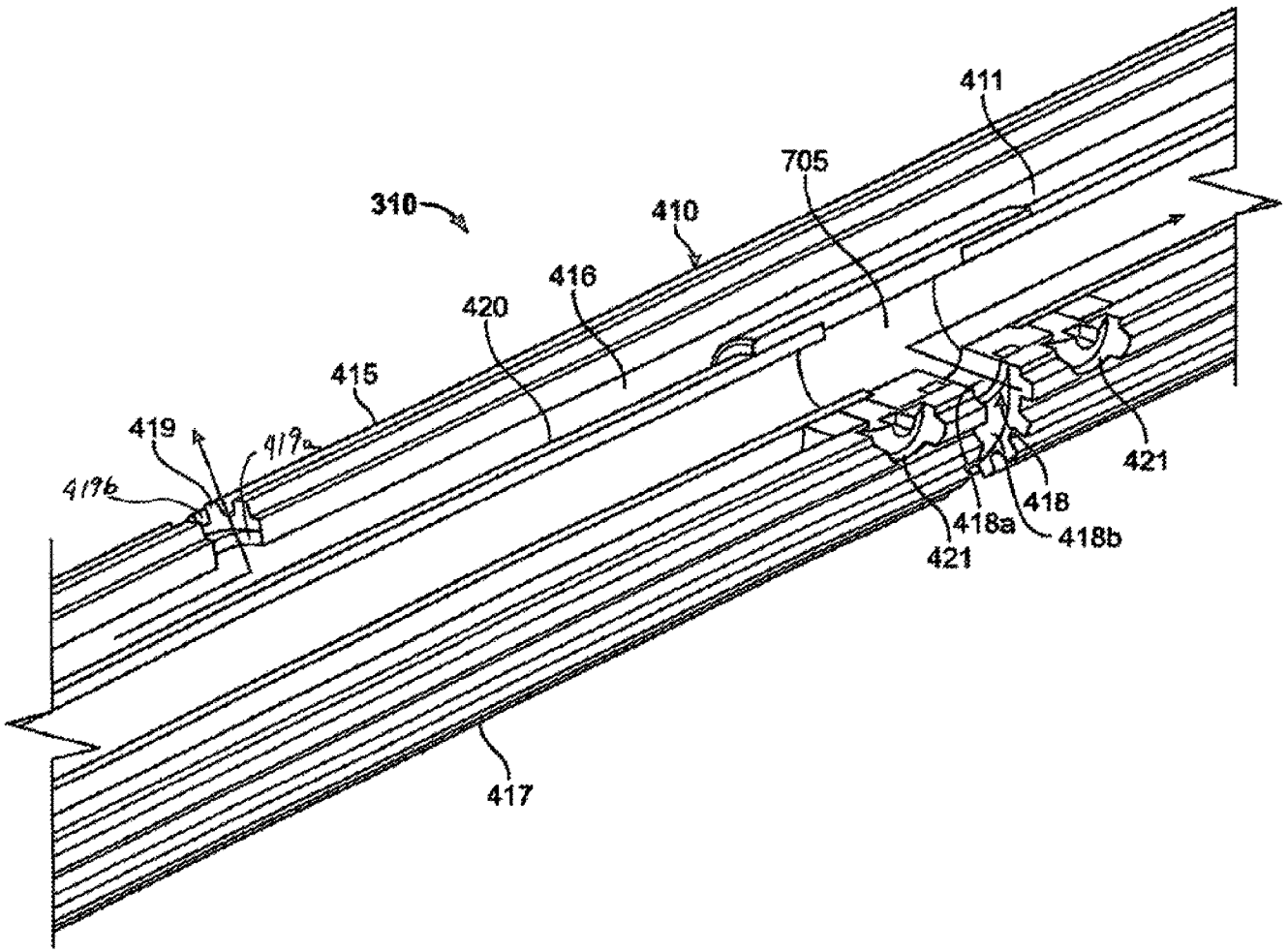
Figure 11 – Cut - away of Rotor.

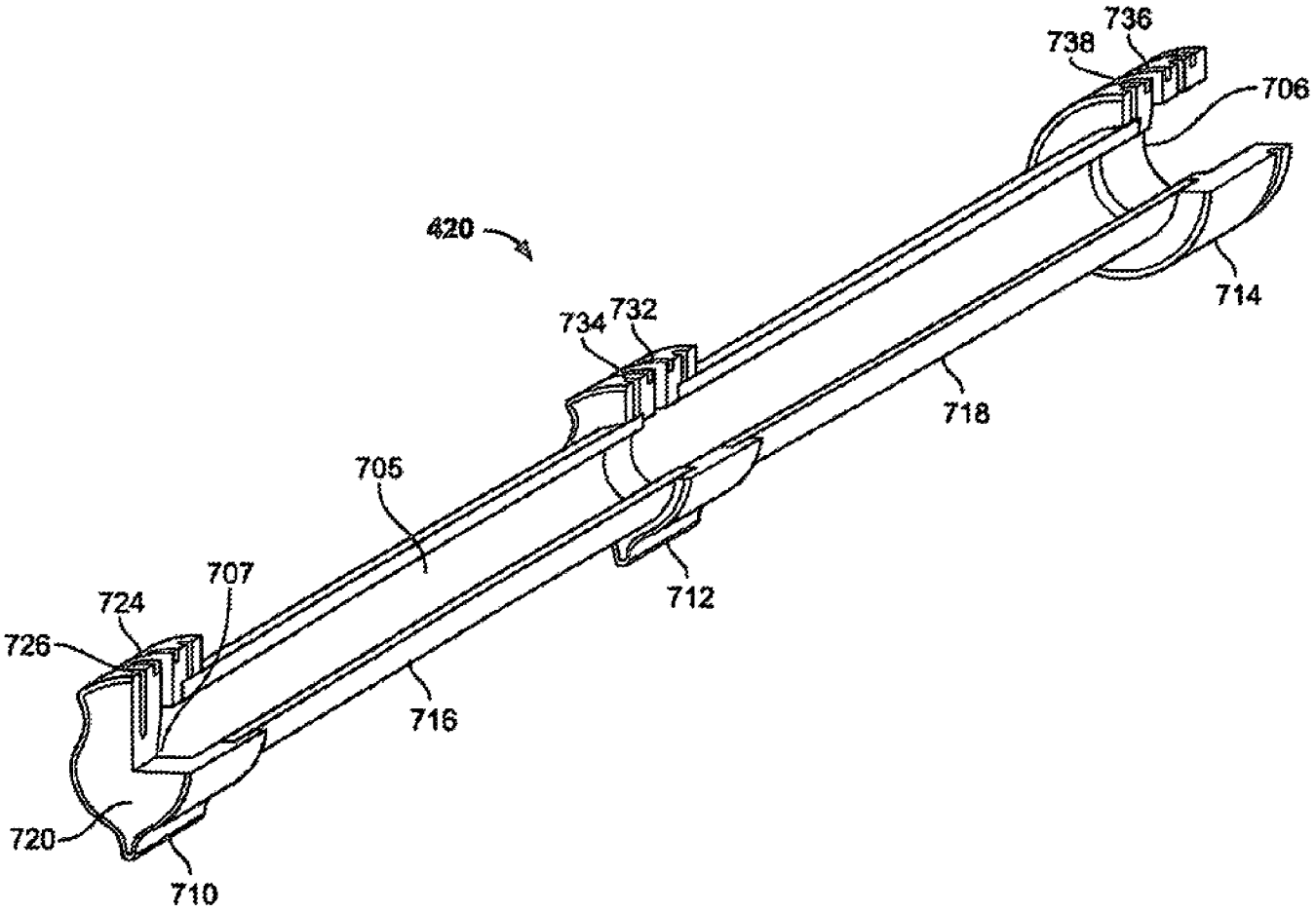
Figure 12 – Cut-away of Exhaust Manifold Assembly.

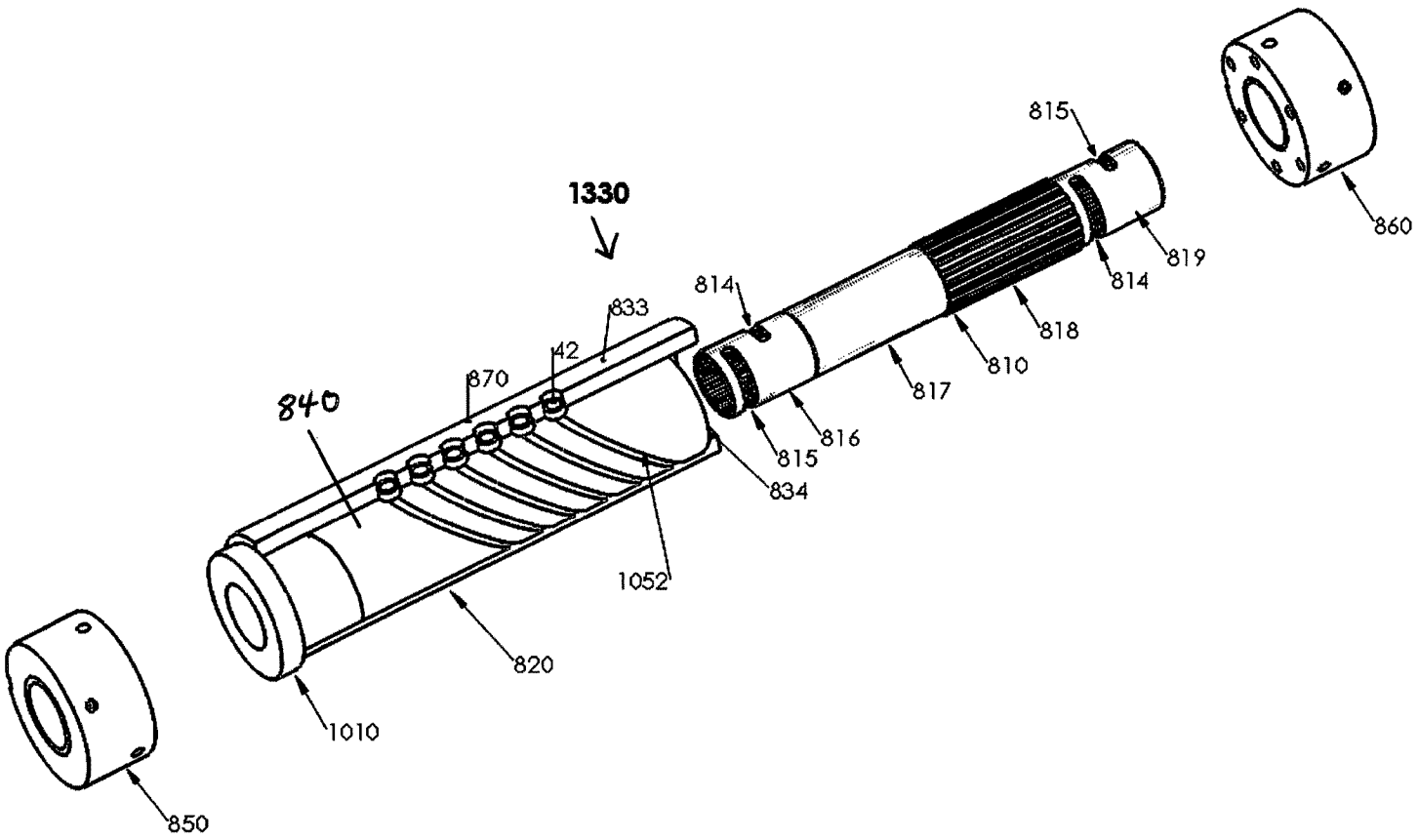
Figure 13 – Exploded View of Power Module.

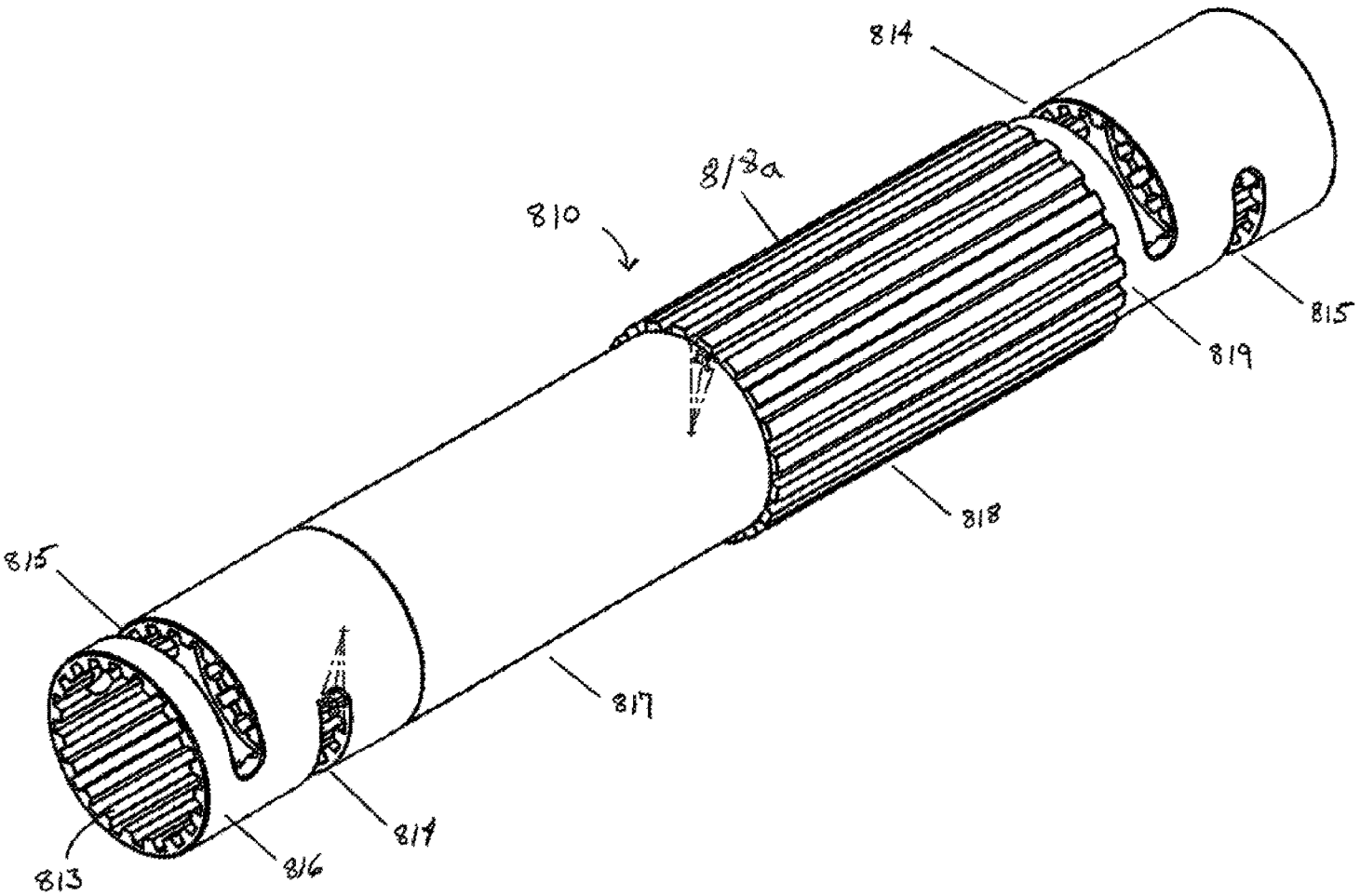
Figure 14– Isometric View of Valve, Piston Sleeve and Harmonic Drvive Spline.

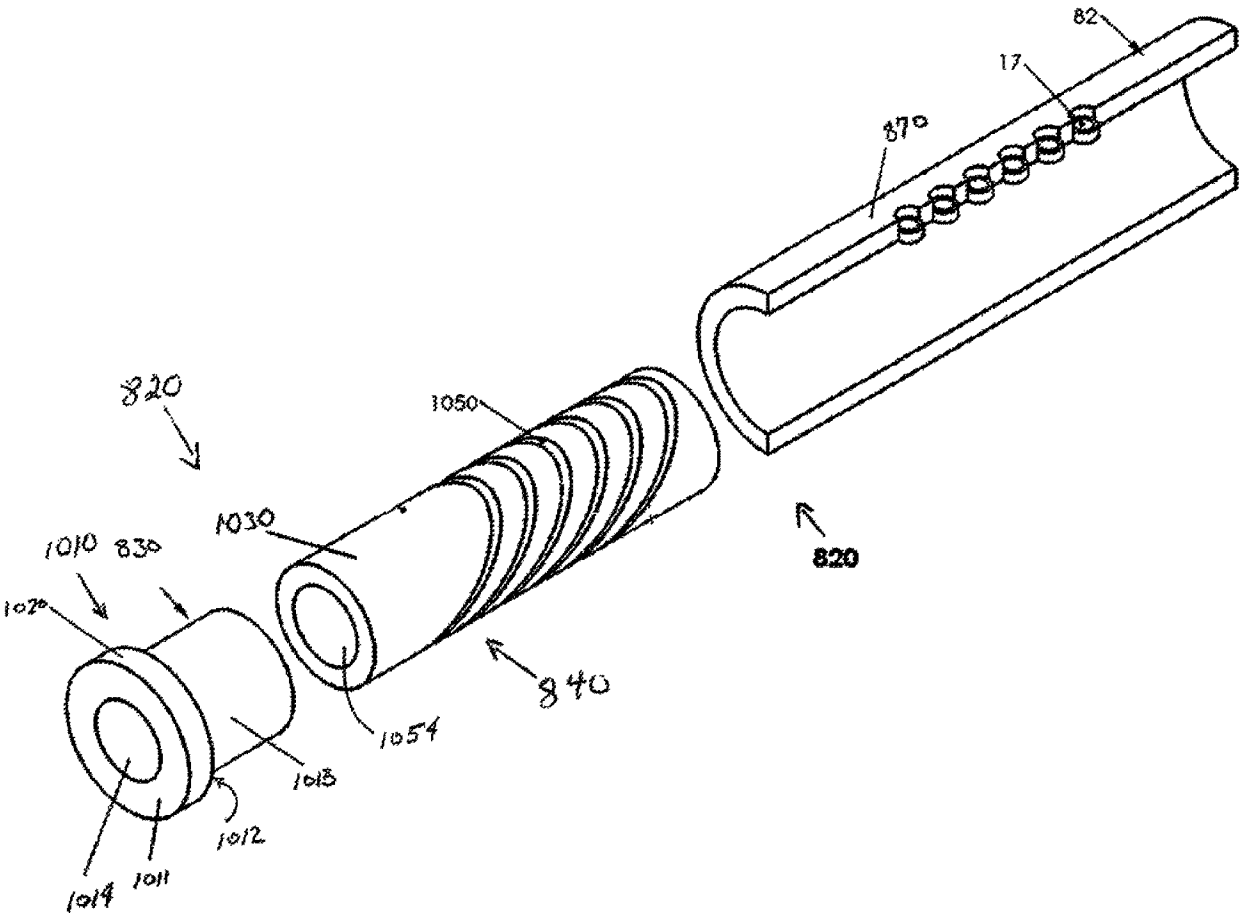
Figure 15 – Exploded View of Piston and Harmonic Drive Assembly.

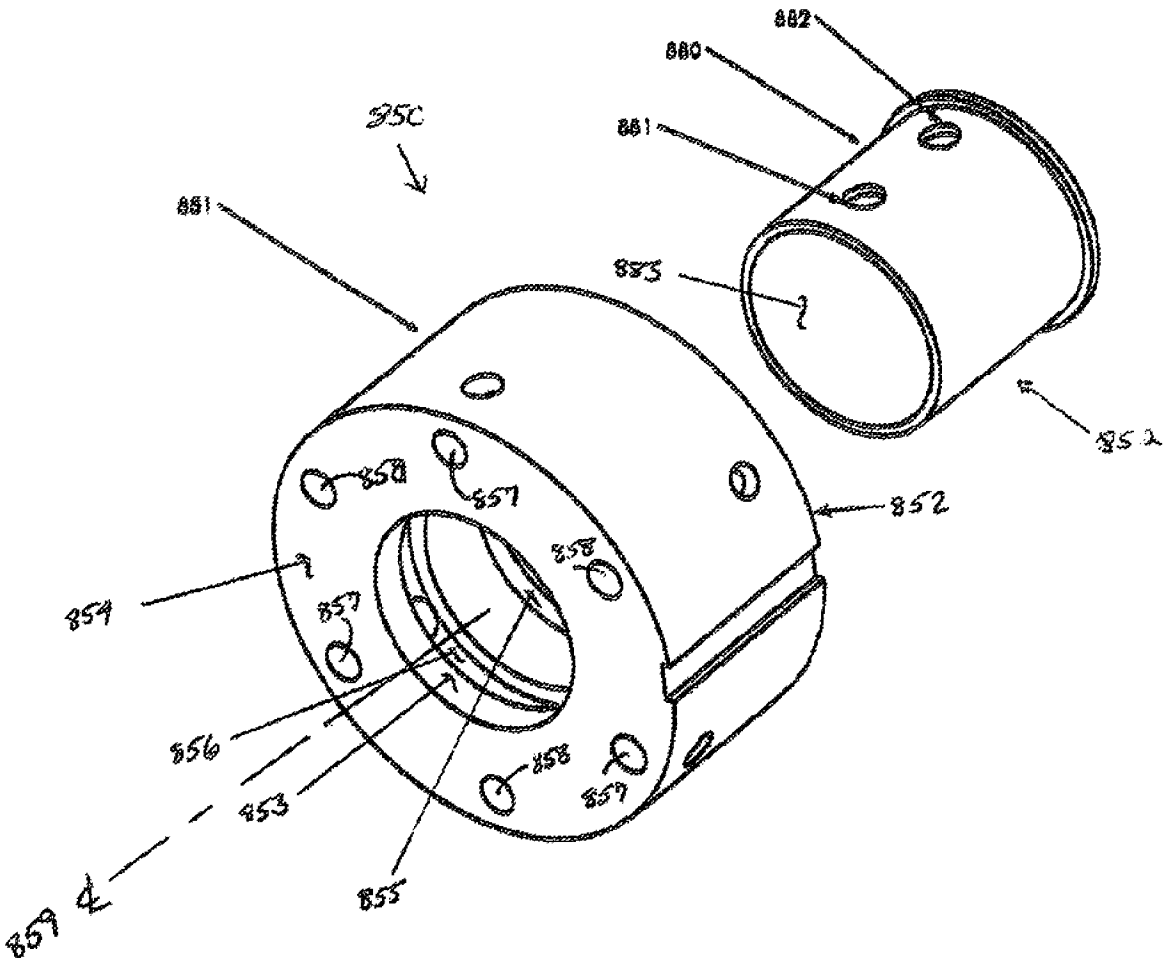
Figure 16 – Exploded View of Valve Block & Insert.

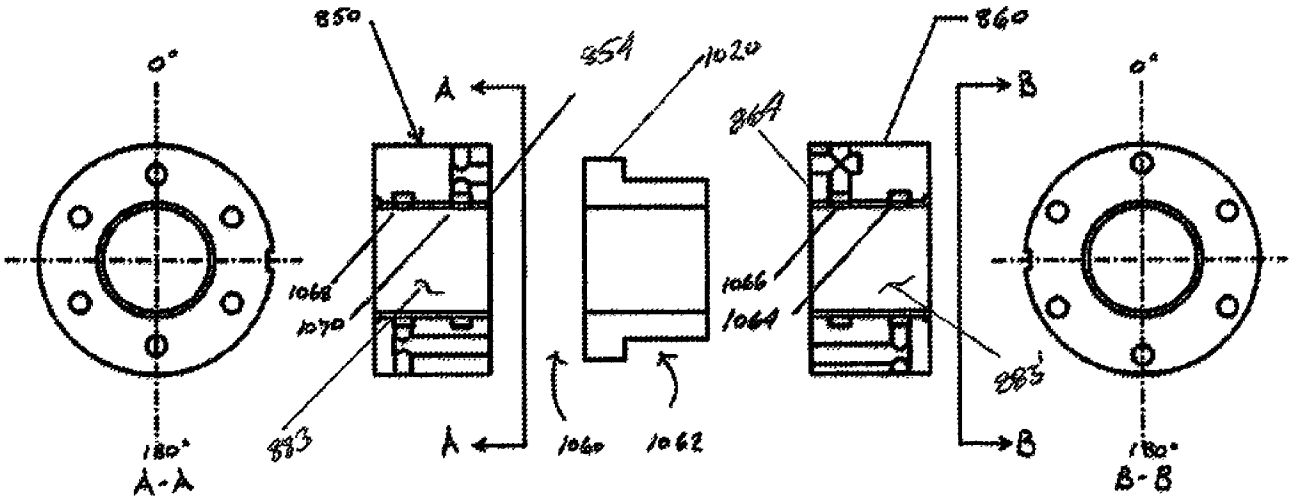
Figure 17 – Valve Block Assembly Cross-Section.

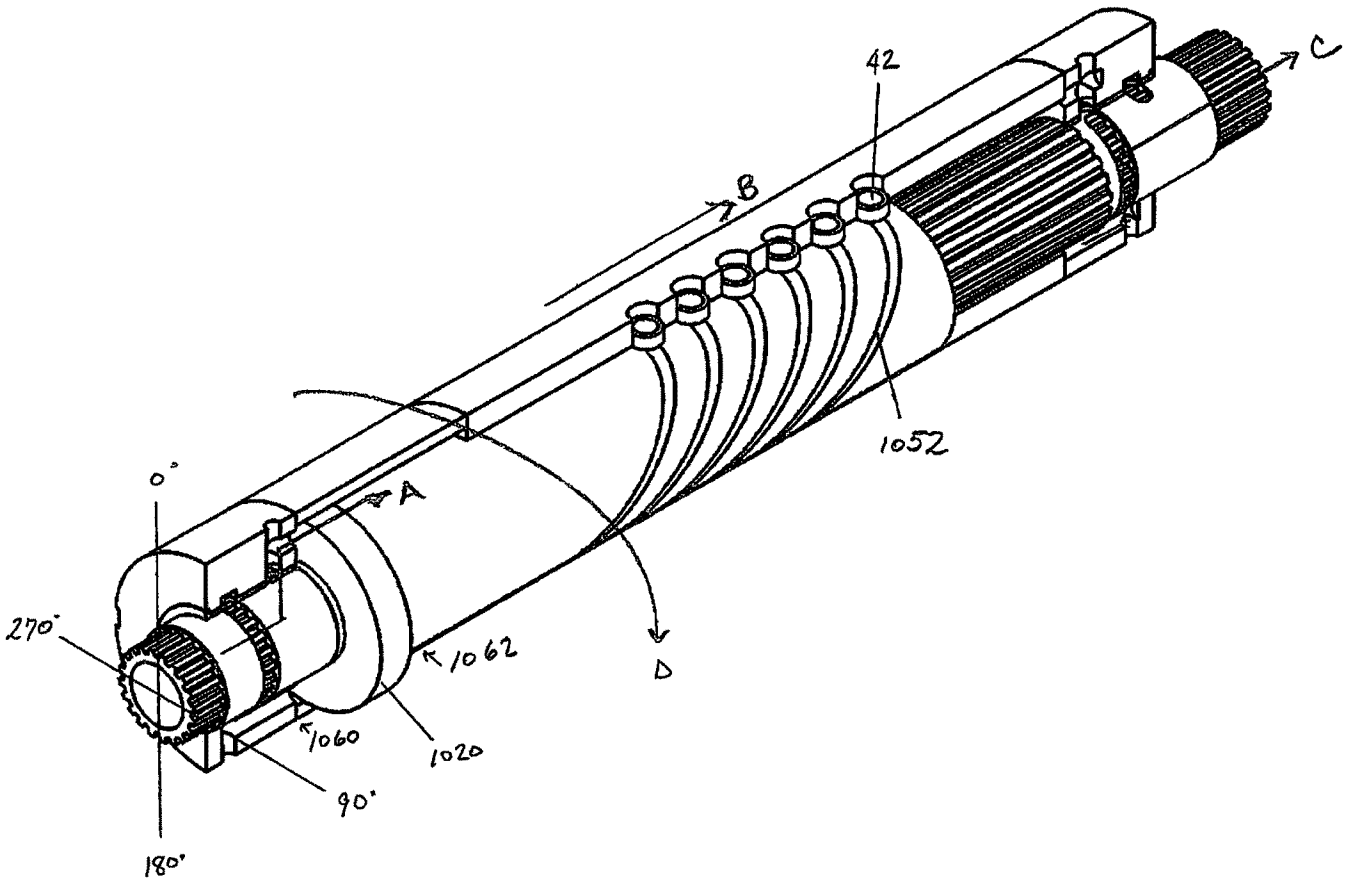
Figure 18 – Initial Position of Valve and Harmonic Drive at 0 Degrees.

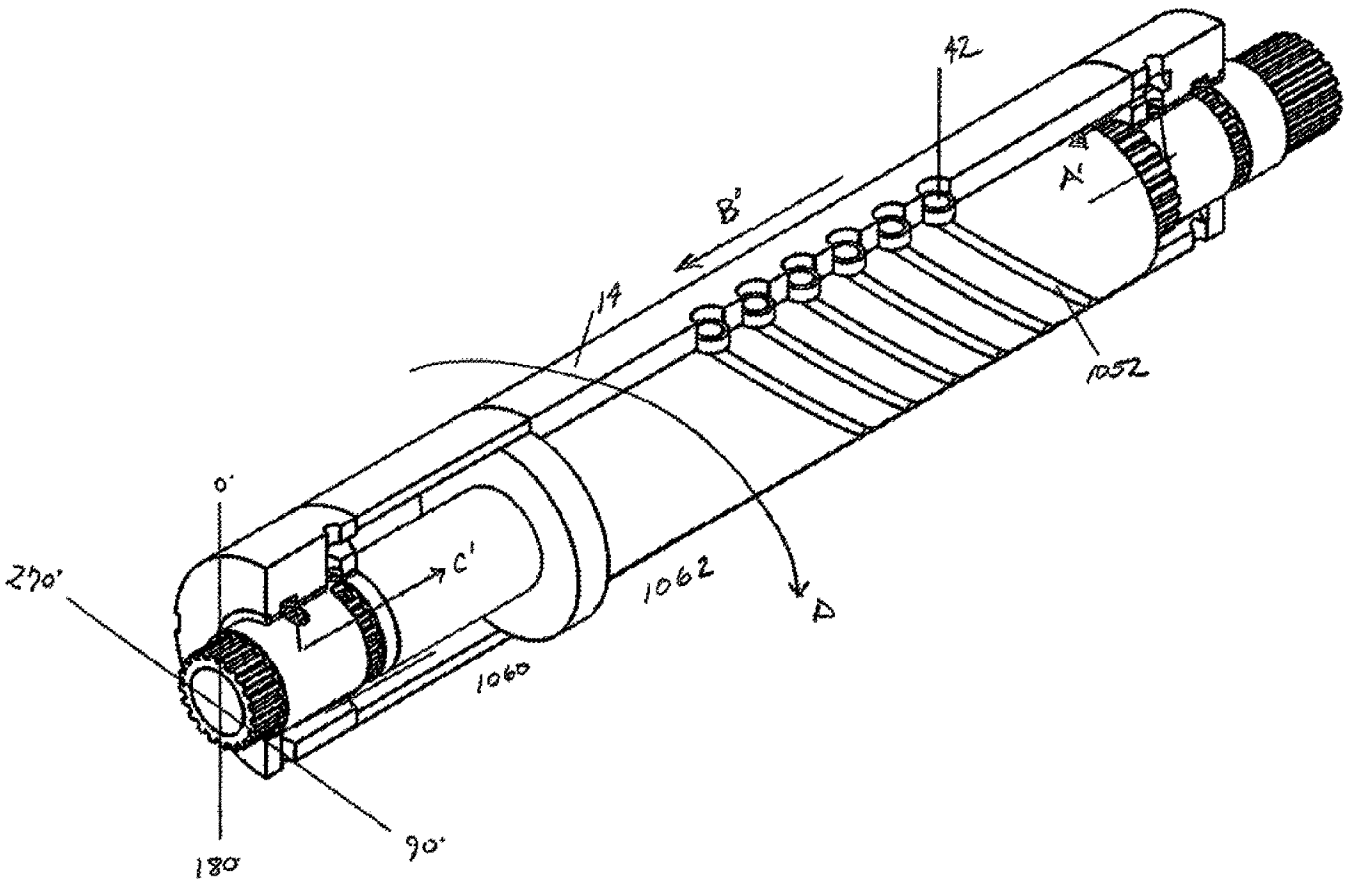
Figure 19 – Final Position of Valve and Harmonic Drive at 180 Degrees.

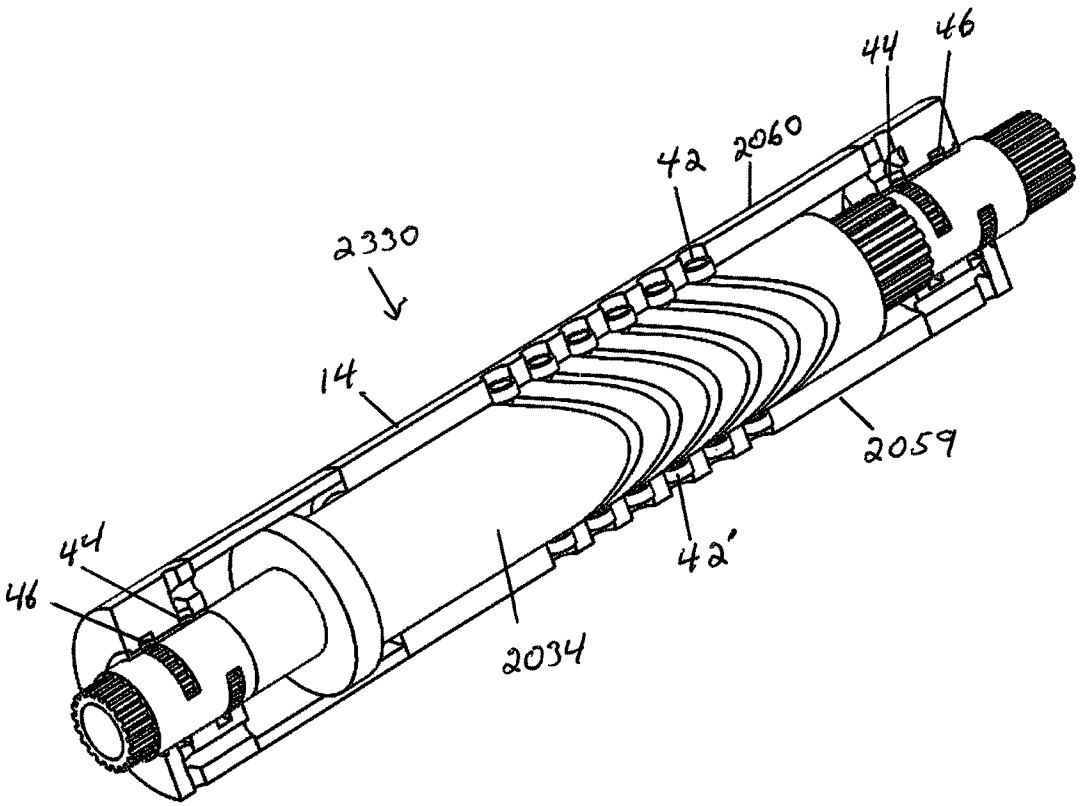
Figure 20 – Module A with Multiple Cycles per Revolution and Modified Valve Porting.

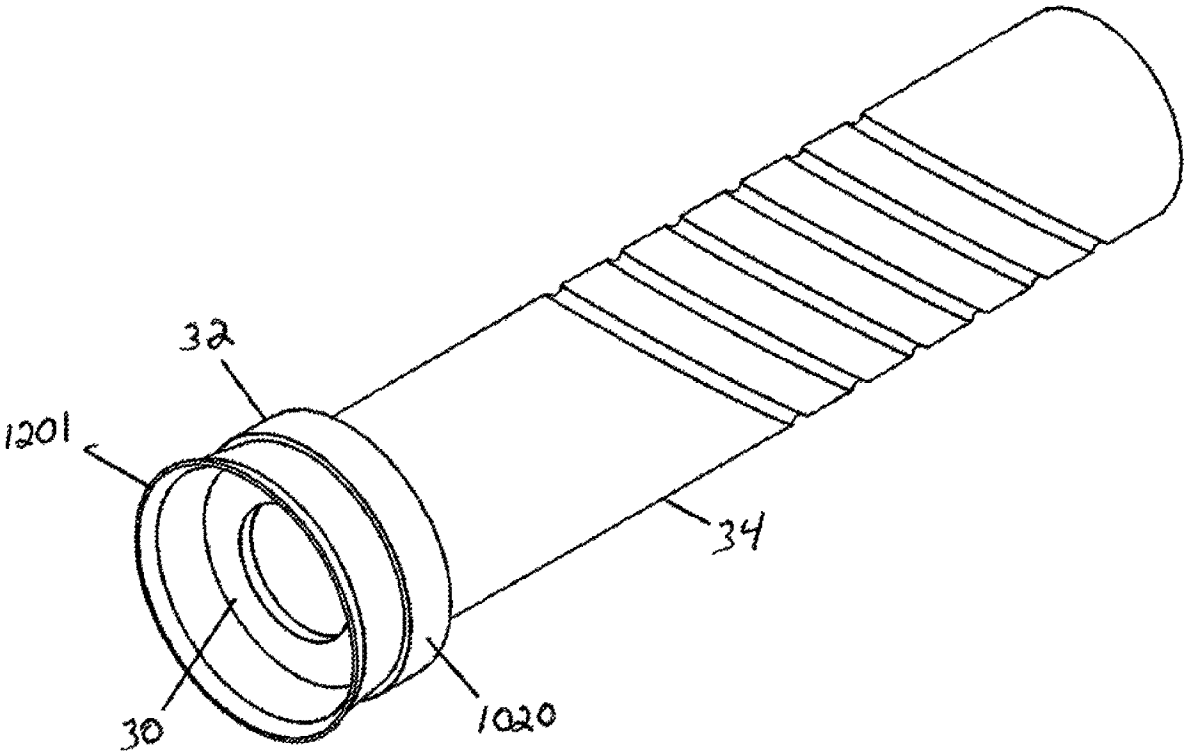
Figure 21– Piston with Cup Seals for Low Temperature Operation.

| Module Sequence Pairs | | Trailing Module | | | |
|---|---|---|---|---|---|
| | | A | | B | |
| Leading Module | A | AA | A'A | AB | A'B |
| | | AA' | A'A' | AB' | A'B' |
| | B | BA | B'A | BB | B'B |
| | | BA' | B'A' | BB' | B'B' |

Figure 22 - Module Sequence Pairs.

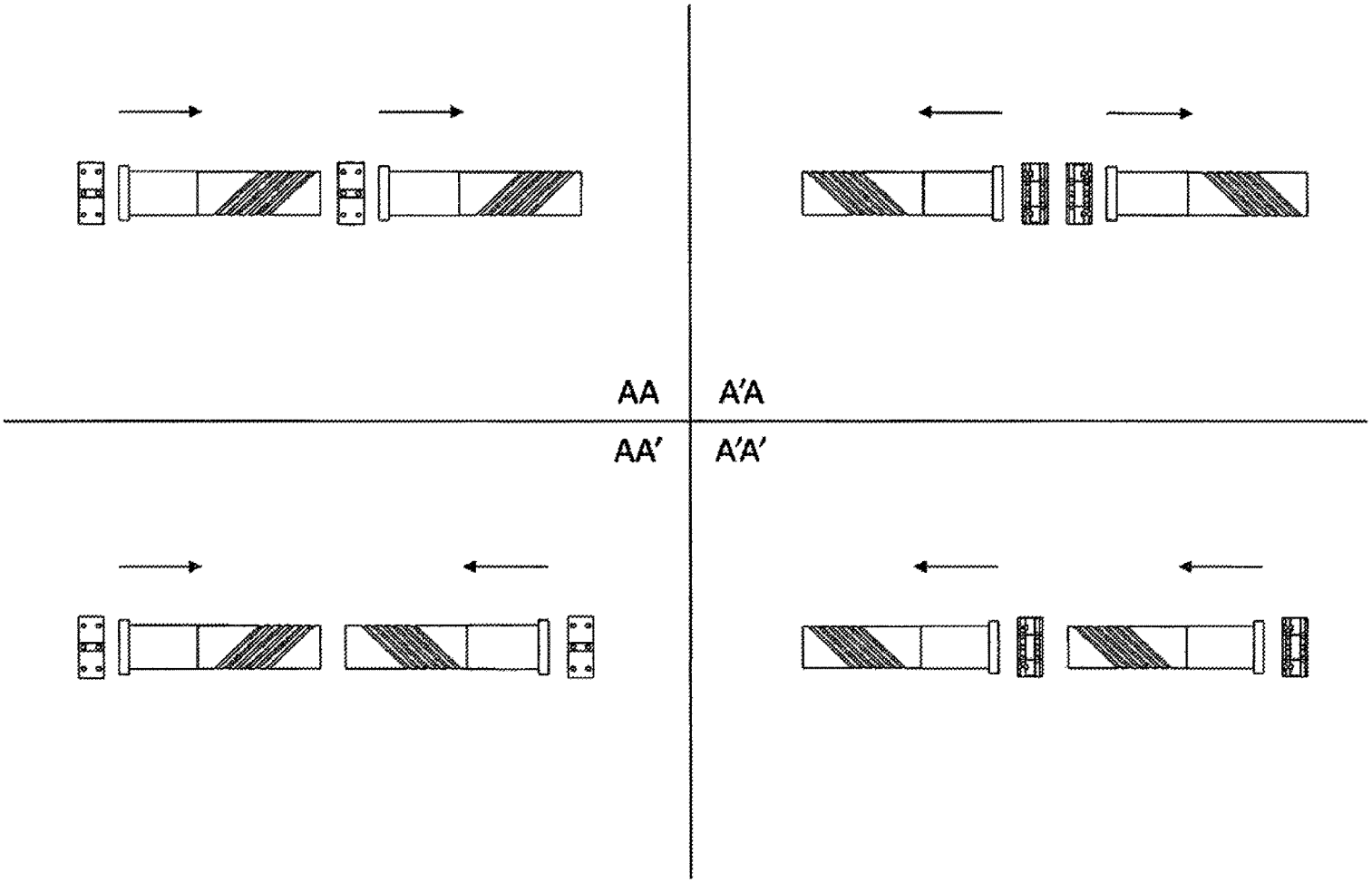
Figure 23A – AA Module Sequence Pairs - Expanded.

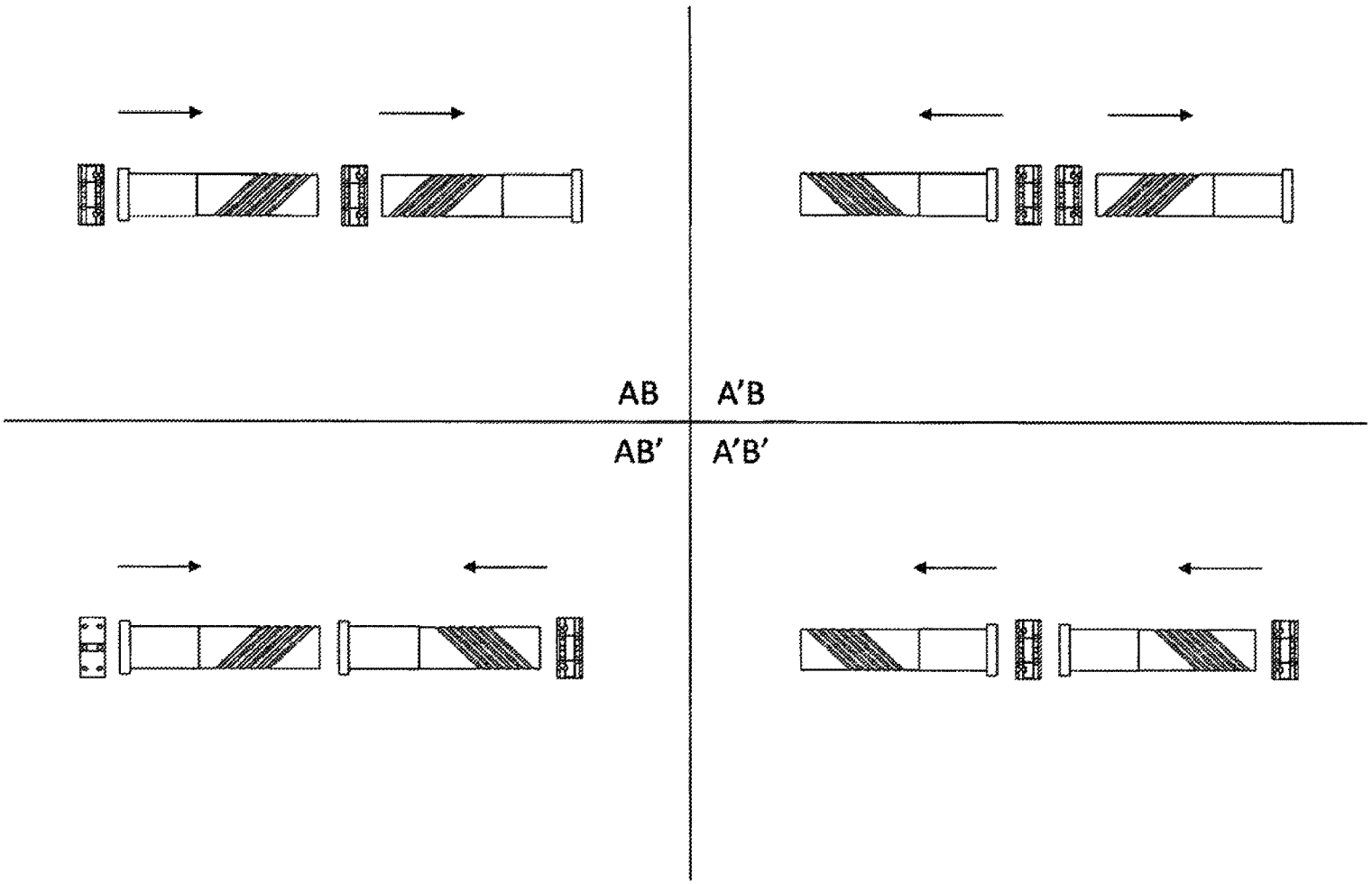
Figure 23B – AB Module Sequence Pairs - Expanded.

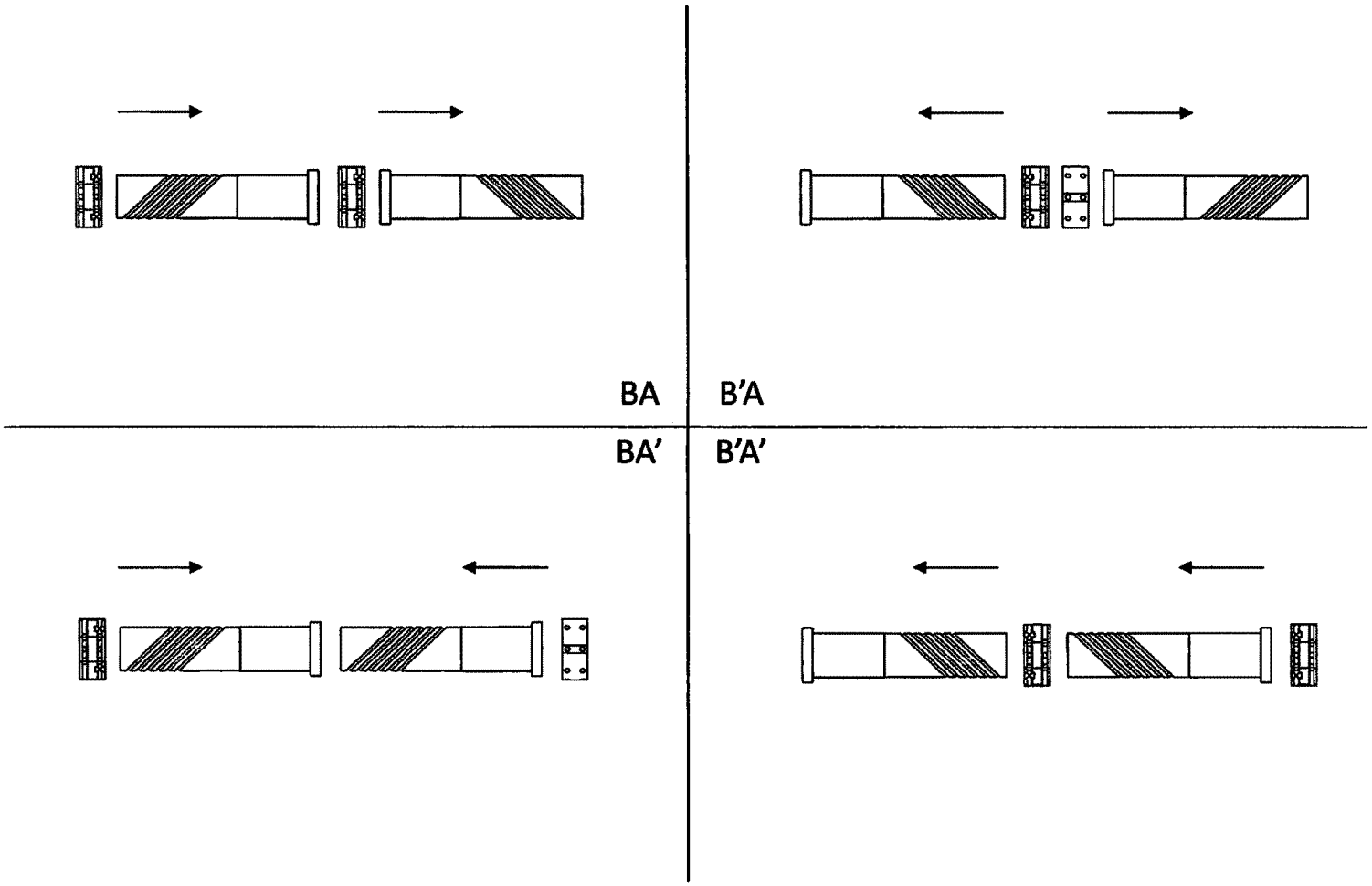
Figure 23C – BA Module Sequence Pairs - Expanded.

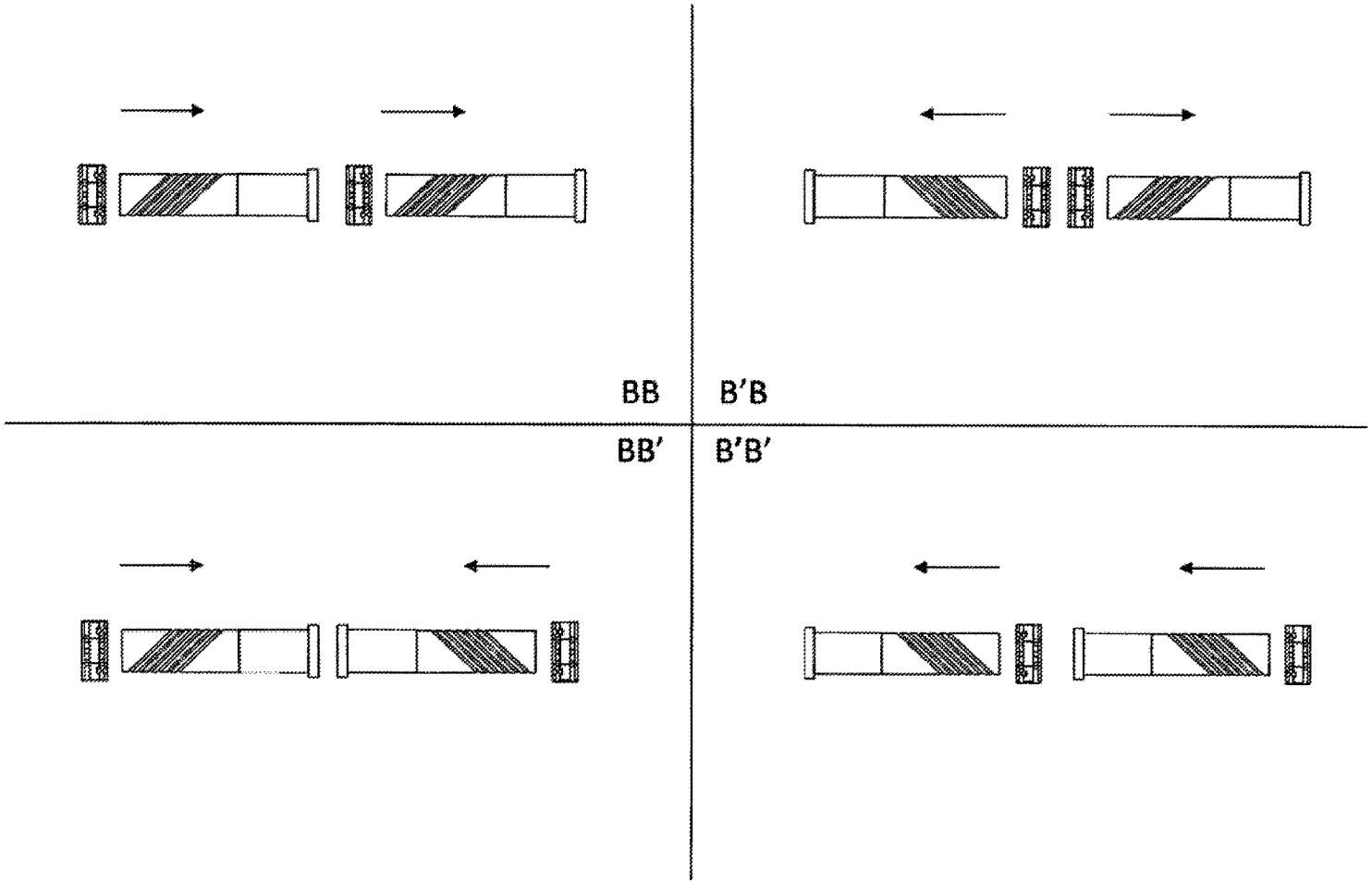
Figure 23D – BB Module Sequence Pairs - Expanded.

MODULAR FLUID POWERED LINEAR PISTON MOTORS WITH HARMONIC COUPLING

CROSS-REFERENCE TO RELATED APPLICATIONS

This application claims priority to U.S. Provisional Patent Application Ser. No. 62/142,837, "FLUID POWERED MOTORS, filed on Apr. 3, 2015, and this application is a Continuation-in-Part of U.S. patent application Ser. No. 14/209,840, "FLUID POWERED LINEAR PISTON MOTOR WITH HARMONIC COUPLING", filed on Mar. 13, 2014, currently pending, which is a Continuation-in-Part of U.S. patent application Ser. No. 14/198,377, "FLUID POWERED LINEAR PISTON MOTOR WITH HARMONIC COUPLING", filed on Mar. 5, 2014, abandoned, which claims benefit of U.S. Provisional Patent Application No. 61/785,539, "AIR/HYDRAULIC MOTOR WITH PISTON/RECIRCULATING BALL TRANSFER MECHANISM", filed Mar. 14, 2013, which are incorporated by reference herein in their entireties.

STATEMENT OF GOVERNMENT INTEREST

The United States Government has rights in this invention pursuant to Contract No. DE-AC04-94AL85000 between the United States Department of Energy and Sandia Corporation, for the operation of the Sandia National Laboratories.

FIELD

The present invention relates to the field of drilling, and specifically to using a pressurized fluid to drive a rotational drill assembly.

BACKGROUND

Downhole drills are used for oil drilling, geothermal drilling, and other deep earth penetration applications. Downhole drills include rotary and percussive drills. For nearly any drilling method, rotational energy must be transferred downhole in order to promote rock reduction. The drill bit may be rotated by an electric motor or fluid/hydraulic system. The rotating action can be produced either at the surface or near the drill bit. In addition to rotational cutting, drills may also be pressurized or mechanically actuated to force the drill bit to hammer against the rock/earth. Prior art rotation systems and methods are complex, require large form factors to create sufficient torque, and require a high degree of maintenance.

The most common method of downhole energy transfer is rigid drill pipe. The drill pipe is rotated from the surface, with drilling joints added for tripping (moving in and out of the hole). For this type of system, the entire drill string rotates. Typically a rotary table system or a top drive is used to drive the drill string. Although it is well suited for vertical drilling, it has limited applications in directional drilling because the drill string curvature and thrust loads generate additional torque that the surface based motor must overcome and drill pipe survive.

Downhole techniques used to generate rotation such as positive displacement motors (PDMs) are limited in their temperature range due to the use of elastomers. Energy resources like geothermal and deep oil and gas wells lie in hot (160° C.–300° C.), and often hard rock. The high-temperatures limit the use of PDM's in those environments.

In addition, PDMs generate rotation by eccentric motion of the rotor around the motor case which induces significant lateral vibration to the drilling assembly.

What is needed is a drill rotation system and method that overcomes the limitations of the prior art.

BRIEF DESCRIPTION OF THE DRAWINGS

FIG. 1 illustrates a motor module at the beginning of a power stroke according to an embodiment of the disclosure.

FIG. 2 illustrates a motor module according to another embodiment of the disclosure.

FIG. 3 illustrates a motor module according to another embodiment of the disclosure.

FIG. 4 illustrates a motor module according to another embodiment of the disclosure.

FIG. 9 illustrates a cut away view of a rotor assembly according to an embodiment of the disclosure.

FIG. 10 illustrates a exploded view of a rotor assembly of FIG. 9.

FIG. 11 illustrates a partial view of a cut-away section of the rotor assembly of FIG. 9.

FIG. 12 illustrates a cut-away view of an exhaust manifold according to an embodiment of the disclosure.

FIG. 13 illustrates an exploded view of an AB' configured power module according to an embodiment of the disclosure. The power module is shown without a piston liner for simplicity.

FIG. 14 is an isometric view of a valves and a sleeve assembly according to an embodiment of the disclosure.

FIG. 15 is an exploded view of a piston assembly, harmonic drive assembly and drive liner according to an embodiment of the disclosure.

FIG. 16 is an exploded view of a valve block assembly according to an embodiment of the disclosure.

FIG. 17 illustrates several views of the valve block assembly of FIG. 16.

FIG. 18 illustrates an AB' module at an initial position of 0 degrees according to an embodiment of the disclosure.

FIG. 19 illustrates the AB' module of FIG. 18 at a final position of 180 degrees.

FIG. 20 illustrates an AB' Module according to another embodiment of the disclosure.

FIG. 21 illustrates a piston/harmonic drive according to another embodiment of the disclosure.

FIG. 22 shows various Module sequence pairs according to an embodiment of the disclosure.

FIG. 23A illustrates various Module sequence pairs according to an embodiment of the disclosure.

FIG. 23B illustrates other various Module sequence pairs according to an embodiment of the disclosure.

FIG. 23C illustrates yet other various Module sequence pairs according to an embodiment of the disclosure.

FIG. 23D illustrates yet other various Module sequence pairs according to an embodiment of the disclosure.

SUMMARY

Figure 1A:
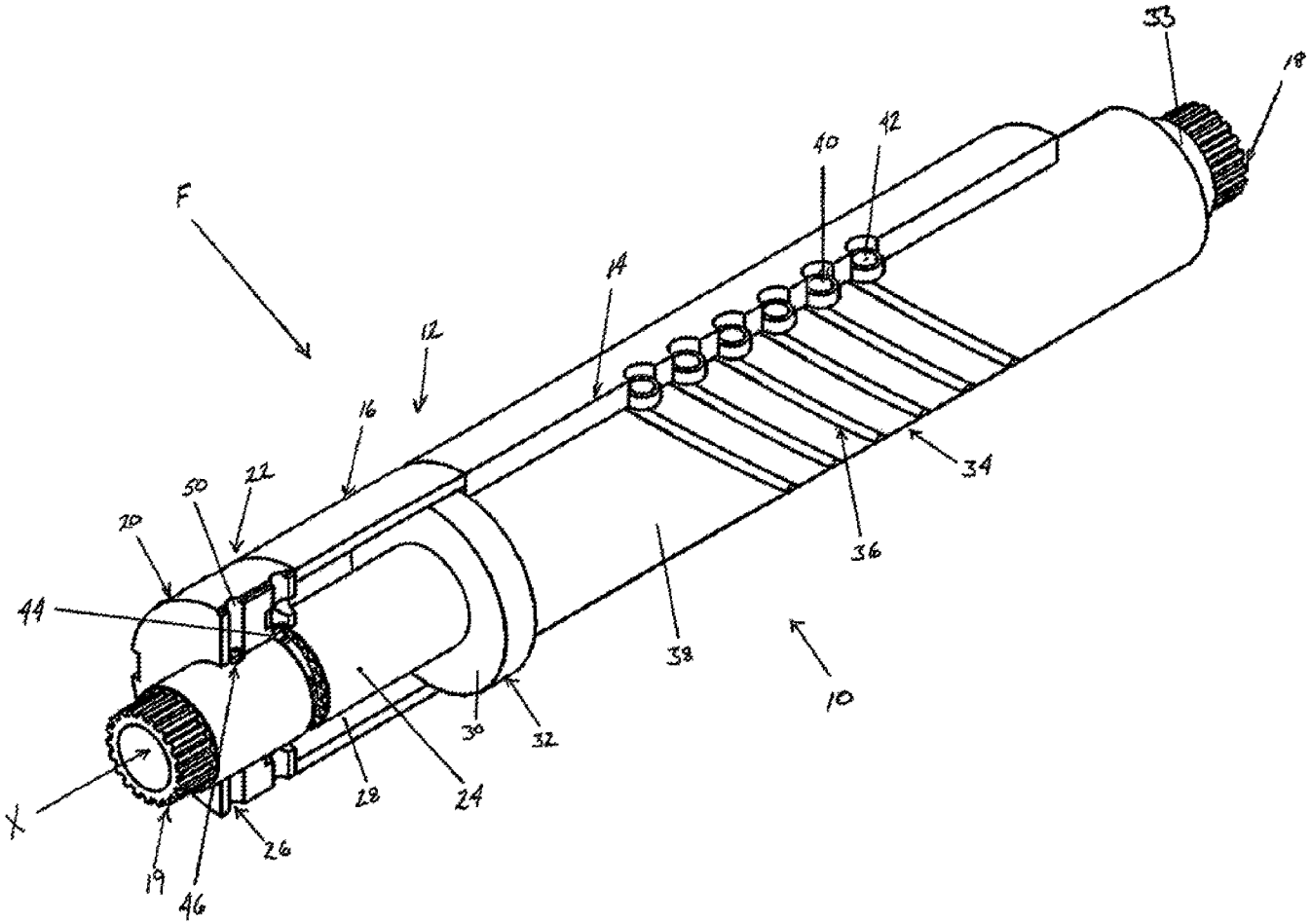
FIG. 1A illustrates the motor module of FIG. 1 at the end of a power stroke.

According to an embodiment of the disclosure, a motor is disclosed that includes a housing, a piston/harmonic drive assembly disposed within the housing, a rotor assembly, wherein the piston/harmonic drive assembly comprises a piston and a harmonic drive, a liner disposed between the piston/harmonic drive assembly and the rotor, and a valve assembly fluidly coupled to the housing. Fluid provided from the rotor assembly to the valve assembly axially drives the piston/harmonic drive assembly over the liner, and axially driving the piston/harmonic drive assembly over the liner imparts rotation to the rotor assembly.

According to another embodiment of the disclosure, a drill assembly is disclosed that includes a drill assembly housing, a fluid driven motor assembly disposed within the drill assembly housing, and a drill bit attached to and rotationally driven by the fluid driven motor assembly. The fluid driven motor assembly includes one or more fluid driven motors that include a housing, a piston/harmonic drive assembly disposed within the housing, a rotor assembly, wherein the piston/harmonic drive assembly comprises a piston and a harmonic drive, a liner disposed between the piston/harmonic drive assembly and the rotor, and a valve assembly fluidly coupled to the housing. Fluid provided from the rotor assembly to the valve assembly axially drives the piston/harmonic drive assembly over the liner, and axially driving the piston/harmonic drive assembly over the liner imparts rotation to the rotor assembly.

According to another embodiment of the disclosure, a method of powering a motor is disclosed that includes providing pressured fluid to a valve assembly of the motor, porting the pressured fluid to a piston/harmonic drive assembly disposed around a rotor assembly at an initial position to drive the piston/harmonic drive assembly in a first axial direction in the housing, and rotating the rotor assembly by converting force from the axial movement into rotational force.

According to another embodiment of the disclosure, a method of powering a motor assembly is disclosed that includes providing pressurized fluid to one or more fluid motor modules. The one or more fluid motor modules are powered by providing pressured fluid to valve assemblies of the one or more fluid motor modules, porting the pressured fluid to piston/harmonic drive assemblies disposed around a rotor assembly to drive the piston/harmonic drive assemblies in an axial direction, and rotating the rotor assembly by converting force from the axial movement into rotational force.

An advantage of the present disclosure is that the rotor components remain on centerline so as not to introduce dysfunctional lateral vibrations in the drilling assembly.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

FIG. 1 illustrates a fluid-powered linear piston motor module (motor module) 10 according to an embodiment of the disclosure. The motor module 10 may be referred to as "Module A" arrangement. The motor module 10 is shown in an initial or start or initiation of stroke position S. In FIG. 1, fluid is entering the motor module 10 from the direction indicated by the arrow X. As can be seen in FIG. 1, the motor module 10 includes a housing 12 that includes a harmonic drive liner (drive liner) 14 and a piston liner 16. In another embodiment, the housing 12 may be a single, unitary body. The motor module 10 further includes a splined central rotor assembly (rotor assembly) 18 that traverses the motor module 10. The valve assembly 20 includes a valve block assembly 22 and a valve 24. The valve block assembly 22 includes valve block assembly ports 26. The valve 24 rides on the rotor assembly 18 via a mating spline 19, such that the valve 24 rotates with the rotor assembly 18. When the motor module 10 is used in an application, the valve block assembly 22 is rigidly fixed to an outer casing so as not to rotate with the valve 24 and rotor assembly 18. The valve assembly 20 allows fluid conveyed through the rotor assembly 18 and allowed to exit through rotor ports 419 (see FIG. 9) to connect to valve block assembly ports 26 within the valve block assembly 22 to distribute fluid to a piston chamber or fluid reservoir or space 28 (see FIG. 1A). In such a manner, the fluid can apply pressure against piston face 30 of piston 32.

The piston 32 is sealed within the piston liner 16 and transmits a thrust force to a harmonic drive 34 also contained in the housing 12. The piston 32 imparts rotation to the harmonic drive 34 via reaction forces created by oval slots or grooves or harmonic cams (cams) 36. The harmonic cams 36 are on an inclined plane in the outer surface 38 of the harmonic drive 34. The harmonic cams 36 engage a ball transfer arrangement 40 embedded in or attached to the drive liner 14. The ball transfer arrangement 40 includes a plurality of ball transfers 42 that correspond to harmonic cams 36. In another embodiment, one or more ball transfers 42 and corresponding harmonic cams 36 may be used. The ball transfer arrangement 40 resists rotation via reaction torque applied by the drive liner 14.

In this embodiment, the piston 32 and harmonic drive 34 are rigidly attached such that rotation of the harmonic drive 34 rotates the piston 32. In another embodiment, the piston 32 and harmonic drive 34 may be rotationally free from one another. The piston 32 and harmonic drive 34 may be collectively referred to as a piston/harmonic drive assembly 35. The harmonic drive assembly 35 is rigidly attached rotationally to the rotor assembly 18 so that rotation of the harmonic drive 34 rotates the rotor assembly 18 which rotates the valve 24. As the piston 32 imparts longitudinal motion to the harmonic drive 34, the ball transfer arrangement 40 imparts rotation to the harmonic drive 34. In such a manner, the piston 32 and harmonic drive 34 longitudinally travel over a sleeve assembly 33, which is disposed around rotor assembly 18 in a fixed manner by splines (not shown). In this exemplary embodiment, the valve 24 and sleeve assembly 33 are separate components that abut over the rotor assembly 18. In another embodiment, the valve 24 and sleeve assembly 33 may be a single, unitary component. The piston/harmonic drive assembly 35 is keyed to the sleeve assembly 33 so the piston/harmonic drive assembly 35 may longitudinally move over the drive liner 14 while rotating the sleeve assembly 33 and thus rotating the rotor assembly 18.

Full displacement of the piston 32 longitudinally allows the pressure supply valve 44 on the rotor assembly 18 to close and likewise open an exhaust port on valve 24 that allows the fluid to be expelled from the cylinder and into another space or reservoir, for example, into exhaust manifold 420 shown on FIG. 10, during the return motion of the piston. In such a manner, the valve block assembly 22 and valve 24, piston 32 and piston liner 16, and harmonic drive 34 and drive liner 14 are fitted with important features that allow conversion of hydraulic power to shaft power.

FIG. 1A shows the motor module 10 in an end or finish of stroke position F. As can be seen in FIG. 1A the piston 32 and harmonic drive 34 have been moved by fluid pressure on the piston 32. At this point, the valve 24 has rotated so that fluid in fluid space 28 can exit through valve exhaust port 50 and rotor exhaust port 46 into the rotor assembly 18 as the fluid space 28 is reduced as the modular motor 10 returns to its initial position A shown in FIG. 1 by a force applied by another module or module portion, as will be discussed below.

The motor module 10 operates by the rotor conveying pressurized fluid from a high pressure source and distributing it to perform fluid expansion within the module and discharge it into an exhaust manifold on rotor centerline following fluid expansion. This motor module configuration, herein referred to as Module A, is "isolated" or "closed" as the power fluid is isolated from the harmonic drive assembly (which refers to the combination of the harmonic drive 34 and ball transfer arrangement 40), since the fluid is contained within the fluid space 28 between the valve block assembly 22 and the piston face 30. Note the motor module 10 generates torque and rotation within the rotor assembly 18 during one-half of the rotor rotation as the piston 32 traverse its stroke with torque generation proportional to the pressure on the piston face 30.

FIG. 2 illustrates another motor module (motor module) 60 according to another embodiment of the disclosure. The motor module 60 may be referred to as a "Module B" arrangement. The motor module 60 is shown in an initial or start or initiation of stroke position S. As can be seen in FIG. 2, the motor module 60 includes the same components used in FIG. 1 with the exception that the piston/harmonic drive assembly 35 has been reversed allowing the power fluid to flow across the harmonic drive 34 through fluid space 28 (the space between the harmonic drive 34 and the drive liner 18 and an expanding space fluidly connected to the back piston surface 62) to lubricate and cool it during module operation, as the fluid pressure reacts against the back piston face 62 (facing the harmonic drive 34) to drive the piston 32. As in the previously discussed motor module 10 (see FIGS. 1 and 1A), the motor module 60 includes a splined central rotor (rotor) 18 that traverses the motor module 60. A valve assembly 20 rides on the rotor assembly 18 via a mating spline 19 and allows fluid conveyed through the rotor assembly 18 to connect to valve block assembly ports 26 within a valve block assembly 22 to distribute the fluid to the piston face 62. The piston 32 is sealed within the piston liner 16 and transmits a thrust force to a harmonic drive 34 that imparts rotation of the rotor and its mating components that include sleeve assembly 33 and piston-harmonic drive assembly 35 with respect to the motor housing 12 via reaction forces on oval grooves 36 on an inclined plane of the harmonic drive 34 where it reacts with a ball transfer arrangement 40 attached to the drive liner 14. The ball transfer arrangement 40 is housed within the drive liner 14 and resists rotation via reaction torque applied by the drive liner 14. Full displacement of the piston 32 longitudinally allows the pressure supply valve 44 on the rotor assembly 18 to close and likewise open an exhaust port 46 on valve 24 that allows the fluid to be expelled from the another fluid space 28' during the return motion of the piston 32. The another fluid space 28' includes space between the harmonic drive 34 and sleeve assembly 33 and the housing 12. It should be noted that the pressure supply valve 44 and exhaust port 46, while shown as open slots on FIGS. 1, 1A and 2, have not been shown as open slots on FIGS. 3, 4, 18, 19 and 20 for simplicity.

The valve block assembly 22 and valve 24, piston 32 and piston liner 16, and harmonic drive 34 and drive liner 14 are fitted with important features that allow conversion of hydraulic power to shaft power. The motor module 60 operates by distributing the power fluid across the harmonic drive 34 to drive the piston 32. This motor module 60 configuration is designated as "open" as it allows flow from the valve block assembly 22 to move across the harmonic drive 34 to pressurize and exhaust the back piston face 62 of the piston.

FIG. 3 illustrates yet another fluid powered liner piston motor module (motor module) 80 according to an embodiment of the disclosure. The motor module 80 may be referred to as "Module B" arrangement. The motor module 80 is shown in an initial or start or initiation of stroke position S. As can be seen in FIG. 3, the motor module 80 includes the same components used in motor module 60 shown in FIG. 2, however, motor module 80 is a mirror image or transpose of motor module 60. The motor module 80 is "open" as it operates by distributing the power fluid across the harmonic drive 34 during the power stroke of the piston 32.

In one embodiment, the motor modules may act independently with rotational power generated over one-half of the piston stroke while the rotor momentum is used to return the piston to its initial position. In another embodiment, the foregoing modules (Module A, Module B, Module B') use paired combinations for operation as the piston 32 within each module completes its return stroke under power by an adjacent or companion module. Since modules A & B', are complementary for this purpose, a bi-directional motor module can be conceived by combining the two cycles. Bi-directional here means powered in forward and return piston directions. The overall motor only operates clockwise unless the valves are reversed or by flowing backwards through the entire assembly. In a similar manner, motor module 10 may mirrored or transposed to create a Module A'

FIG. 4 illustrates a hybrid, bi-directional fluid-powered linear piston motor module (hybrid motor module) 120, which may be referred to as "Module AB", according to an embodiment of the disclosure. The hybrid motor module 120 is shown in an initial or start or initiation of stroke position S. The hybrid motor module 120 includes rotor assembly 18 with mating pressure supply 44 and exhaust valves 46, piston 32 and piston liner 16, harmonic drive 34 and ball transfer arrangement 40, to generate torque and rotation within the rotor assembly 18.

The hybrid modular motor 120 combines the forward stroke (in the direction of fluid direction X) of motor module 10 (Module A) by fluid expanding in a first fluid space (see FIG. 1A) and the return stroke (in the opposite direction of fluid direction X) of motor module 80 (Module B') by fluid expanding in another fluid space 28' to create bi-directional, contracted, power motor module 120. In other words, the hybrid modular motor 120 operates by expansion of the fluid within the first fluid space 28 (see FIG. 1A) (the space between the valve block assembly 22 and the piston face 30) to generate forward motion (motion in the fluid direction X), and by expansion of the fluid within a second fluid space 28' (the space between the second valve assembly 20' and the opposing piston face (not shown), to generate reverse motion (motion opposite fluid direction B). As will be appreciated by one of ordinary skill in the art, the porting of the second valve assembly 20' is 180° out of phase with the porting of the valve assembly 20. This porting arrangement will be described in further detail below.

Figure 5:
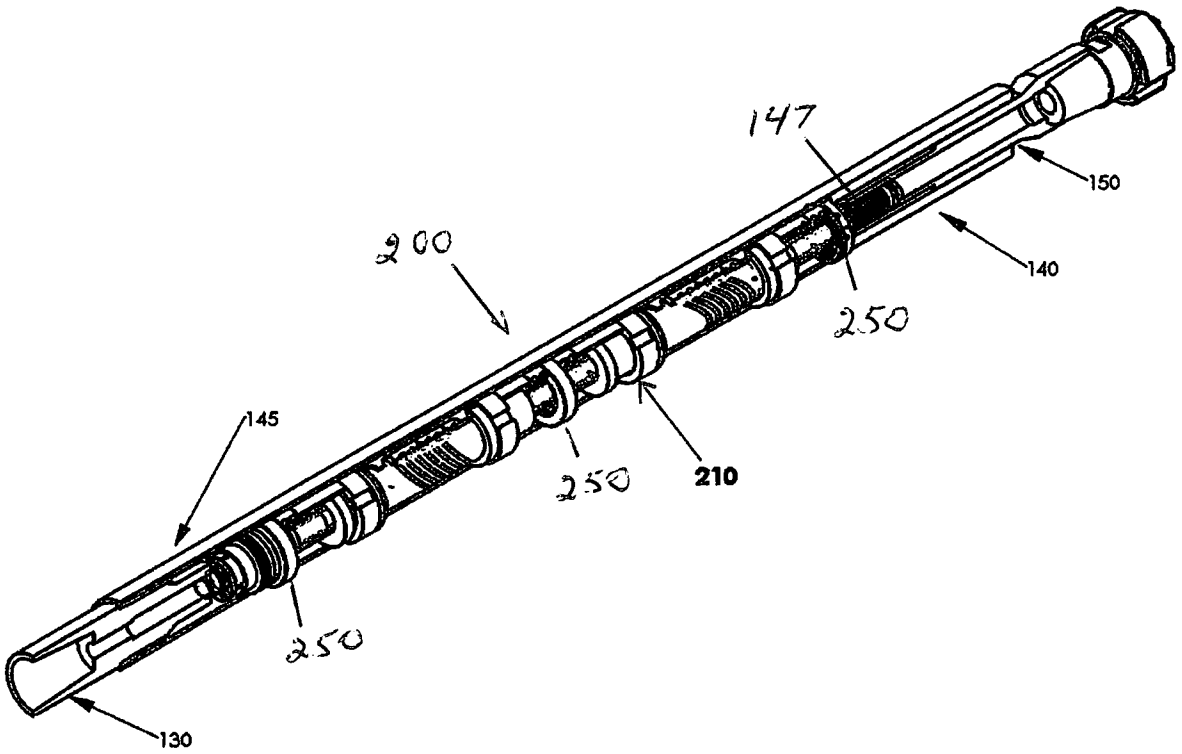
FIG. 5 illustrates a partial cut-away view of a drilling assembly according to an embodiment of the disclosure
Figure 6:
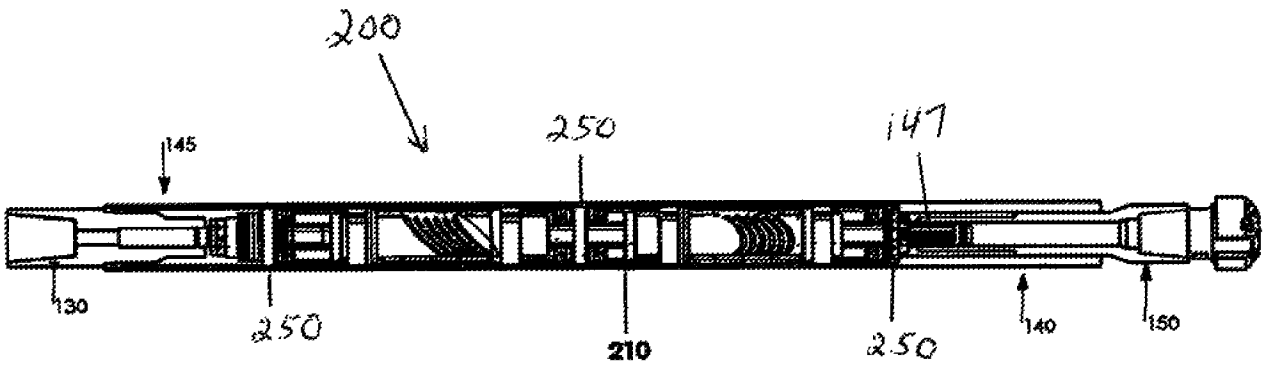
FIG. 6 illustrates a partial cut-away side view of the drilling assembly of FIG. 5.

FIGS. 5 and 6 illustrate a drilling assembly 200 according to an embodiment of the disclosure. The drilling assembly 200 includes a housing 145, a fluid inlet section 130 disposed at one end of the housing 145, and a fluid outlet section 140 disposed at an opposite end of the housing 145. The drilling assembly 200 also includes a rotary bit assembly 150 coupled to the fluid outlet section 140. The drilling assembly 200 also includes a fluid motor assembly (motor assembly) 210 disposed in the housing 145 and in fluid connection with the fluid inlet section 130 and the fluid outlet section 140.

Figure 7:
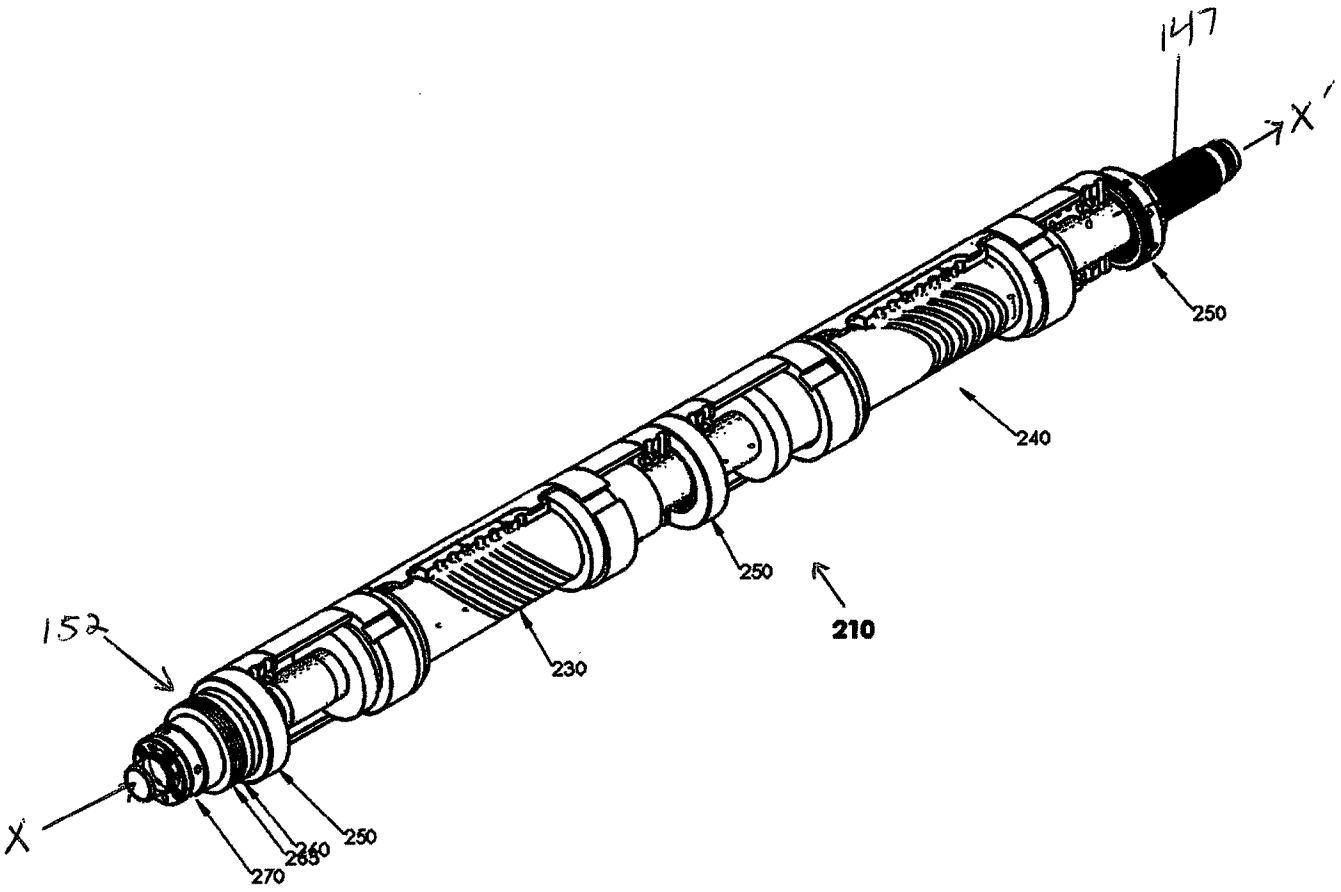
FIG. 7 illustrates a motor assembly according to an embodiment of the disclosure.

FIG. 7 illustrates an embodiment of a fluid motor assembly (motor assembly) 210 according to an embodiment of the disclosure. The motor assembly is formed by the serial connection of two AB' motor modules 230, 240 on a common rotor assembly 147. The two AB' motor modules 230, 240 may be referred to as a first AB' motor module 230 and a second AB' motor module 240. The AB' motor modules are configured as shown on FIG. 4. The motor assembly 210 includes mounting hardware 152 that includes bearings 250 at each end and between the motor modules 230, 240. The hardware also includes a spring 260, washers 265, and a lock nut retainer 270 for preloading the motor modules 230, 240 on the rotor assembly 147. The direction of fluid flow into the rotor assembly 147 is indicated by arrow X, and the direction of fluid flow exiting the rotor assembly 147 is indicated by arrow X'.

Figure 8:
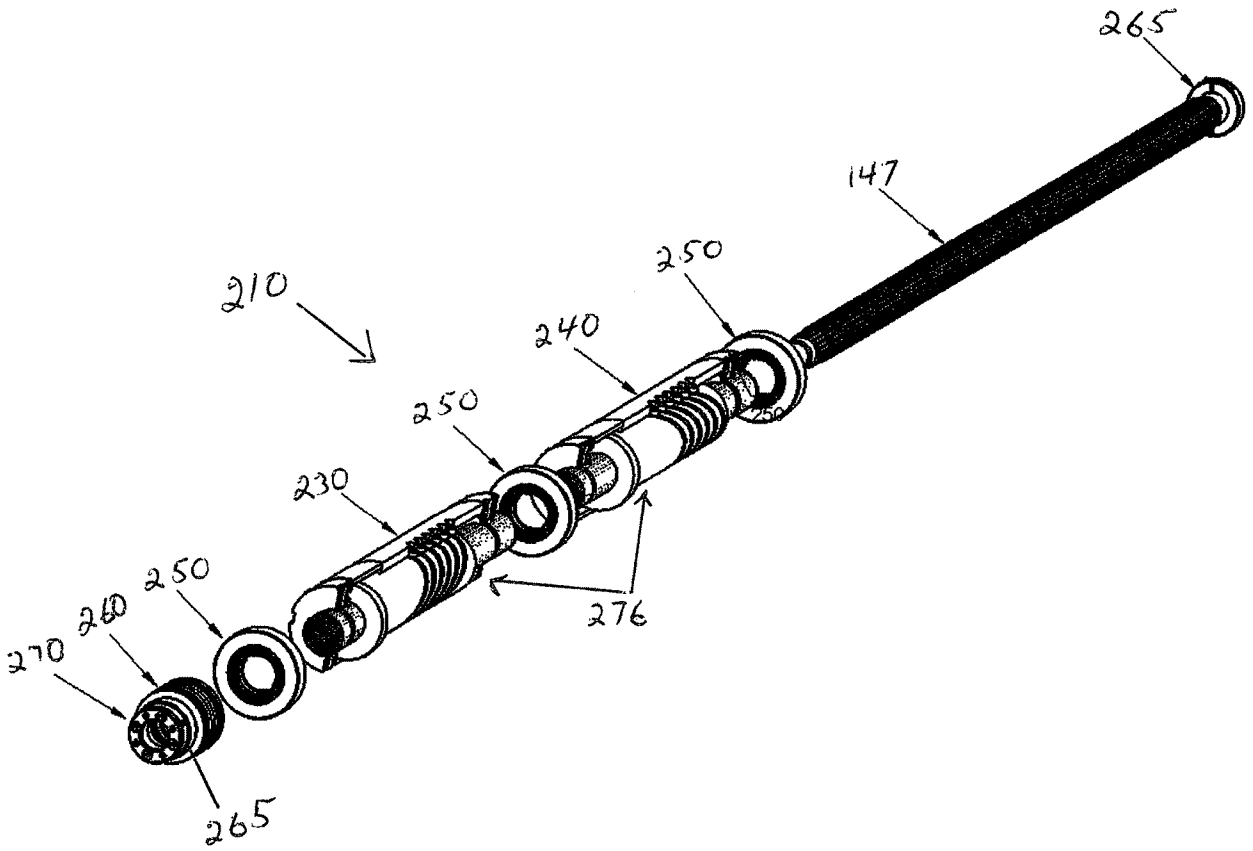
FIG. 8 illustrates a partial exploded view of the motor assembly of FIG. 7.

FIG. 8 is a partially exploded view of the motor assembly 210 of FIG. 7. As can be seen in FIG. 8, the motor assembly 210 includes rotor assembly 147, the first AB' motor module 230, the second AB' motor module 240, bearings 250, spring 260, washers 265 and lock nut retainers 270. The bearings 250, spring 260, washers 265 and retainers 270 are assembled as shown to assemble the first and second AB' motor modules 230, 240 upon the rotor assembly 147 under a preload. In this exemplary embodiment, the piston drive section 276, which includes the two AB' motor modules 230, 240 however, in another embodiments, the piston drive section 276 may include one or more AB' motor modules 230. In another embodiment, washers 265 may be positioned at other locations axially along the rotor assembly 147, or may be deleted. In another embodiment, one or more springs 260 may be positioned axially along the rotor assembly 147.

In another embodiment, the piston drive section 276 may include one or more spacers located at one or more positions axially along the rotor assembly 147. In another embodiment, spacers may be replaced with another module to increase the output power of the motor assembly 210.

FIGS. 9, 10 and 11 show different views of a rotor assembly 310 according to an embodiment of the disclosure. As can be seen in FIGS. 9-11, the rotor assembly 310 includes a rotor housing 410 and an exhaust manifold 420. The rotor housing 410 has a through passage 411 having a pressure inlet 412 and an exhaust outlet 414.

The rotor housing 410 also has an outer surface 415 and an inner surface 416. The outer surface 415 includes splines 417 disposed on the surface thereof. In this exemplary embodiment, the outer surface 415 has splines 417 substantially covering the entire outer surface 415. In another embodiment, the outer surface 415 may have splines 417 covering only a portion of the outer surface 415.

The rotor housing 410 also includes pressure ports 419 that allow a fluid to pass from the inner surface 416 to the outer surface 415. In this exemplary embodiment, the rotor housing 410 includes three pressure ports 419. As can be seen in FIG. 11, the pressure ports 419 include an opening 419*a* into the inner surface 416 and a radial slot 419*b* in the outer surface 415 of the rotor housing 410. The radial slot 419*b* provides for increased fluid collection over the surface of the rotor housing 410. In another embodiment, the rotor housing 410 may include one or more pressure ports 419.

The rotor housing 410 also includes exhaust ports 418 that allow a fluid to pass from the outer surface 415 to the inner surface 416. In this exemplary embodiment, the rotor housing 410 includes three exhaust ports 418. As can be seen in FIG. 11, the exhaust ports 418 include an opening 418*a* into the inner surface 418 and a radial slot 418*b* in the outer surface 415 of the rotor housing 410. The radial slot 418*b* provides for increased fluid collection over the surface of the rotor housing 410. In another embodiment, the rotor housing 410 may include one or more exhaust ports 418.

The rotor housing 410 also includes fastener openings 421 between the outer surface 415 and the inner surface 416 that allow a fastener to attach the exhaust manifold 420 to the rotor housing 410.

FIG. 12 shows a cross sectional view of an exhaust manifold 420 according to an embodiment of the disclosure. As can be seen in FIG. 7, the exhaust manifold 420 includes a fluid passageway 705, a first port junction 710, a second port junction 712 and a port collar 714. The fluid passage 705 has a first end 706 that is open and a second end 707 that is closed.

The first port junction 710 is fluidly connected the second port junction 712 by a first exhaust pipe 716. The second port junction 712 is fluidly connected to the port collar 714 by a second exhaust pipe 718. In another embodiment the first and second exhaust pipes 716, 718 may be replaced with a single exhaust tube that has corresponding ports.

The first port junction 710 includes an end cap 720 for sealing a first end 722 of fluid passage 705. The first port junction 710 also includes a first exhaust port 724 for allowing a fluid to enter the fluid passageway 705, and a first fastener attachment point 726 for allowing the first port junction 710 to be attached to the rotor housing 410 (see FIGS. 9 and 11).

The second port junction 712 includes a second exhaust port 732 for allowing a fluid to enter the fluid passageway 705, and a second fastener attachment point 734 for allowing the second port junction 712 to be attached to the rotor housing 410 (see FIGS. 9 and 11).

The port collar 714 includes a third exhaust port 736 for allowing a fluid to enter the fluid passageway 705, and a collar attachment point 738 for allowing the port collar 714 to be attached to the rotor housing 410 (see FIGS. 9 and 11).

As can be seen in FIG. 12, the exhaust manifold 420 is configured so that the port collar 714 creates a seal between the exhaust manifold 420 and the rotor 410. Referencing FIGS. 9 and 12, it can be seen that in such a manner, the through passage 411 is divided into a pressure chamber 411A and an exhaust chamber 411B. As the exhaust manifold 420 is open to the through passage 411 at open end 706 and closed at closed end 707, the through passage 411 is part of the exhaust chamber 411B.

In this exemplary embodiment, the rotor assembly 310 has three pressure and exhaust ports, one for each end of each module assembly 230, 240 (although only three each are shown in FIGS. 9-11). In another embodiment, the rotor assembly 310 may be configured with one or more pressure and exhaust ports, corresponding to the number of module assemblies.

As can be seen in FIGS. 9 and 11, a pressurized fluid may enter the pressure chamber 411A and be available to be discharged outside of the rotor housing 410 through pressure ports 419, and a pressurized fluid may be collected through exhaust ports 418 into exhaust chamber 411B to be exhausted from the rotor housing 410.

FIGS. 13 and 14 show an expanded view of a module assembly 1330 according to an embodiment of the disclosure. The module assembly 1330 may be referred to as a piston/rotary transfer mechanism, since the module assembly converts a piston action into a rotary motion. As can be seen in FIG. 13, the module assembly 1330 includes a sleeve assembly 810 disposed between a left handed valve 816 and a right handed valve 819, a piston/harmonic drive assembly 820, a left-hand valve block assembly 850, and a right-hand valve lock assembly 860. The piston/harmonic drive assembly 820 includes a piston assembly 1010 and a harmonic drive 840. The sleeve assembly 810 includes a piston portion 817 and a harmonic drive portion 818. The harmonic drive portion 818 has a splined surface 818*a* that engages with corresponding splines (not shown) within the piston/harmonic drive assembly 820. The sleeves 816, 819 and sleeve assembly 810 include a splined inner surface 813 configured to surround and engage with the outer splined surface 415 of rotor housing 410. The left handed valve 816 includes a pressure inlet slot 814 and an exhaust outlet slot 815. The right handed valve 819 includes a pressure inlet slot 814 and an exhaust outlet slot 815. In such a manner, rotation of the rotor housing 410 directly rotates the valve sleeve 810. In this embodiment, the piston harmonic drive assembly 820 is rotationally fixed upon the valve sleeve 810 via the external spline 818 such that the valve sleeve does not rotate with respect to the piston assembly.

FIG. 14 shows a more detailed view of the sleeve assembly 810 and valves 816, 819 according to an embodiment of the disclosure. As can be seen in FIG. 14, the left hand valve 816 and right hand valve 819 include pressure inlet slots 814 and exhaust outlet slots 815 that are offset 180 degrees, circumferentially. The pressure inlet slot 814 and exhaust outlet slot 815 are slotted through the valves 816 & 819 for about 180 degrees of circumference of the valves 816 and 819, respectively, however, the amount of degree of the slot may be varied slightly to adjust the cycle timing of the piston assembly 820 upon the valve sleeve 810 to provide preferred differential pressures across the piston to drive the motor.

Referring again to FIG. 13, the ball transfer drive liner (drive liner) 870 is disposed over harmonic drive 840 of the piston harmonic drive assembly 820. The drive liner 870 includes an outside surface 833 and an inside surface 834. The outside surface 833 includes a keyway for preventing drive liner rotation with respect to the case (not shown). In such a manner, rotation of the harmonic drive 840 within assembly 820 rotates the rotor 410. The inside surface 834 of drive liner 870 also includes ball transfers 42 for engaging the harmonic cams 1052.

FIG. 15 shows a more detailed view of a piston/harmonic drive assembly 820 according to an embodiment of the disclosure. As can be seen in FIG. 15, the piston/harmonic drive assembly 820 includes a piston assembly 1010 having a first face 1011, a second face 1012 opposite the first face, an outside surface 1013, and inside surface 1014, and a collar 1020 disposed around the axial midpoint of the piston assembly 1013.

The piston/harmonic drive assembly 820 further includes a harmonic drive 840 that includes an internal spline (not shown) that locks in corresponding slots or grooves in the sleeve assembly 810 (see FIGS. 13 and 14) that allow the piston/harmonic drive assembly 820 to axially or linearly move within the drive liner 870 and upon the sleeve assembly 810 and radially move or rotate within the drive liner 870. In this exemplary embodiment, the sleeve assembly 810 protrusions are splines, but in another embodiment, the protrusions may be ribs, nubs or other low friction protrusions. In this exemplary embodiment the piston assembly 1010 and the harmonic drive 840 are separate components or units. The piston assembly and harmonic drive 840 may be securely attached, such as by brazing, welding or the use of a fastener. In another embodiment, the piston assembly 1010 and harmonic drive 840 may be a single, unitary component.

As described earlier in the application, the harmonic drive 840 has an outer surface 1030 that includes grooves, slots or tracks that may be referred to as harmonic cams 1050 that have the same geometry and shape. The harmonic cams circumferentially surround the outer surface 1030 to produce a "cam" surface. The harmonic cams 1050 use a surface of revolution that follows a sine wave. The cam surface or slot surface of the harmonic cams 1050 can be prescribed using harmonic motion, cycloidal, or other methods commonly used in cam design.

FIG. 16 shows an exploded view of the left-hand valve block assembly 850 according to an embodiment of the disclosure. The left-hand valve block assembly 850 includes a left-hand valve block body 851 and a left-hand valve block insert 880. An annular gland 855 is machined on the inner surface 853 of the left-hand valve block body 850 to distribute pressurized flow circumferentially around the left-hand valve block assembly 850 to the pressure ports 857 on the valve block face 854. Another annular gland 856 is machined on the inner surface 853 of the left-hand valve block body 850 to relieve exhaust flow circumferentially around the left-hand valve block assembly 850 from the exhaust ports 858 on the valve block face 854. The valve block insert 880 is installed in the valve block body 851 through hole 859 that presents a pressure and exhaust valve alignment port, 881 and 882, respectively, for passage of the pressure (supply) and exhaust (return) flows from the rotor assembly 310 (see FIG. 9) to the piston face 30 (FIG. 4) via pressure supply and exhaust valve ports 44,46, respectively. The right-hand valve block assembly 860 (see FIG. 13) would be similarly configured except that pressure and exhaust ports 881 and 882, respectively, would provide flow to piston face 62 via valve ports 44' and 46', respectively.

The assembly operation will be discussed using an end view reference grid as shown on FIGS. 13 and 16-19. In this reference grid, top dead center (TDC) is 0 degrees (0°). As can be seen in FIG. 17, the left-hand valve block body 850 includes an inside surface 883 and an outside surface 854. The right-hand valve block body 860 includes an inside surface 883' and an outside surface 864. Outside surface 854 and piston collar 1020 at least partially define a first chamber 1060. A second chamber 1062 can be described between the piston collar 1020 and the outside surface 864 of the right-hand valve block 860. The first and second chambers 1060, 1062 are defined between the face of the piston collar 1020 and a corresponding valve block (FIG. 18). The left-hand valve block assembly 850 includes a first chamber pressure inlet 1070 located at 0°, a first chamber pressure outlet 1068 located at 0°; the right-hand valve block 860 includes a second chamber pressure outlet 1064 located at 0°, and a second chamber pressure inlet 1066 located at 0°. The first and second chamber pressure inlets and outlets 1070, 1068, 1066, 1064 are ports in the valve block body that extend through the valve block body 850 and 860, respectively, from the inside surface 883 and 883' to the outside surface 854 & 864, respectively. The first and second chamber pressure inlets 1070, 1066 are aligned with pressure port 419 (FIG. 9) when module 330 is assembled on the rotor assembly 310. The first and second pressure outlets 1068 and 1064 are aligned with exhaust ports 418 when module 330 is assembled on the rotor assembly 310.

Referencing FIGS. 18 and 19, it can be seen that the first and second chambers 1060, 1062 are the empty volume between the collar 1020 and the opposing valve block, respectively. The valve blocks 850 and 860 create a seal between the module assembly 330 and the housing 45. As the collar 1020 moves away from each chamber, the volume increases as fluid expands into the volume. As the collar 1020 move towards each volume, the volume decreases as the fluid is exhausted from the volume.

The fluid flow paths during a cycle of the piston assembly 820 will now be described referencing FIGS. 18 and 19. FIG. 18 illustrates the first module 330 in position on the rotor assembly 310 in an initial position of a cycle. As can be seen in FIG. 18, the collar 1020 is nearly contacting the left-hand valve block 850. At this initial point of the cycle as shown in FIG. 18, the pressurized fluid is following the path indicated by arrow A. As can be seen in FIG. 18, the pressurized fluid is flowing towards the piston assembly 820 via through passage 411 of the rotor housing 410, exits pressure port 419, passes through the pressure inlet slot 814 of the valve sleeve 810, passes through the valve block and enters first pressure inlet 1070 (see also FIG. 17) into the first chamber 1060. Pressure in the first chamber 1060 forces the piston assembly 820 in the direction indicated by arrow B. Simultaneously, fluid from the second chamber 1062 is exhausted as shown by arrow C via second pressure outlet 1064 to the exhaust outlet slot 815 and exhaust port 418 and into the through passage 411 of the rotor housing 410. The exhausted fluid is then received by the outlet section 40.

As the piston assembly 820 travels in the direction of arrow B, the ball transfer 42 travels along the curved ridge 1052 (shown in FIG. 18. As the ball transfer 42 follows the curved ridge 1052 and the piston harmonic drive assembly 820 continues to travel, the piston harmonic drive assembly rotates in the direction shown by arrow D. The rotation of the piston harmonic drive assembly rotates the rotor assembly 310 in same direction D. The rotation of the rotor assembly 310 rotates the second piston harmonic drive in module 340 in the same direction D.

FIG. 19 shows a point in time when the piston assembly 8200 has traveled for the complete stroke length, and the collar 1020 is nearly contacting the drive liner 14. The stroke of the piston has produced one-half of a rotation in the rotor 310. At this point, the pressurized fluid is flowing towards the piston assembly 820 via through passage 411 of the rotor housing 410, exits pressure port 419, passes through the pressure inlet slot 814 of the valve sleeve 810, and enters second pressure inlet 1066 (see also FIG. 17) into the second chamber 1062. Pressure in the second chamber 1062 forces the piston assembly 820 in the direction indicated by arrow B'. Simultaneously, fluid from the first chamber 1060 is exhausted as shown by arrow C' (shown on FIG. 19) via first pressure outlet 1068 to the exhaust outlet slot 815 and exhaust port 418 and into the through passage 411 of the rotor housing 410. The exhausted fluid is then received by the outlet section 40.

As the piston assembly 820 travels in the direction of arrow B', the ball transfer 42 travels along the curved ridge 1052 of the harmonic drive 840 (shown on FIG. 19). As the ball transfer 42 follows the curved ridge 1052 and the piston assembly 820 continues to travel, the piston harmonic drive rotates in the direction shown by arrow D. The rotation of the piston harmonic drive rotates the rotor assembly 310 in same direction D. The rotation of the rotor assembly 310 rotates the piston harmonic drive in module 340 in the same direction D.

The cycle is repeated to continuously rotate the rotor assembly 310. It should be noted that the positioning of the pressure inlet slot 814 and the exhaust outlet slot 815 on the valve sleeve 810 (see FIG. 14) may be extended or retracted to time the input and exhaust of fluid to dynamically tune the cycling of the rotor assembly 310. Multiple modules (330, 340) are clocked or timed circumferentially by receiving and discharging fluid to provide continuous power distribution to the rotor assembly.

FIG. 20 shows an alternate embodiment of Module AB' 2330 with a harmonic drive 2034 that produces two cycles per revolution on the harmonic drive 2034. For this configuration, a second set of ball transfers 42' have been duplicated on a bottom surface 2059 of the drive liner 14 opposite a first set of ball transfers 42 on a top surface 2060 on the drive liner 14 resulting in symmetric reactions within the drive liner 14. The pressure supply and exhaust valve ports 44, 46, respectively, have been modified accordingly to ensure the timings of pressure and exhaust are appropriately synchronized with the piston oscillation.

FIG. 21 shows an additional embodiment with the piston face 30 of piston 32 fitted with an elastomeric cup seal 1201 to form an improved pressure seal on the piston face 30. Alternatively, metal seals (not shown) can be installed around the piston collar 1020 to form a high temperature pressure seal.

FIG. 22 illustrates the available module sequence pairs that can be conceived from Module A (piston centric) and Module B (harmonic drive centric) to produce various functioning motor configurations. While a continuous rotation & torque motor can be conceived using a minimum of any two modules, larger motors can be conceived by the serial connection of a number of modules. As outlined with the design of Module AB' in FIG. 7, FIG. 22 shows that 16 module configurations can be conceived using modules A & B. As shown in the pictorial representation of each of these module sequence pairs in FIG. 23, various hybrid fluid-powered motor arrangements (hybrid motor arrangement) can be conceived according to an embodiment of the invention. The hybrid motor arrangements of FIGS. 22 & 23 combine the major design elements (valve block/valves, piston/liners, and harmonic drive/ball transfer) subassemblies of hybrid motor 210 to arrive at a number of configurations that allow different benefits. For example, as shown herein, Module AB' allows both the piston and harmonic drive assembly to be combined into a single coupled unit. Similarly, while all module A pairs allow isolation of the power fluids from the harmonic drive assembly, module sequence pairs A'A and AA' additionally allow adjacent valve blocks and harmonic drives respectively, to be combined into single components, respectively, to reduce the required number of major design elements and achieve specific performance objectives. Similarly, module sequence pairs B'B and BB' allow valve block coupling and piston coupling, respectively, to be achieved. Other combinations are possible as evidenced in the figures.

As has been shown, the hybrid motor arrangements includes valve block/valves, piston/liners, and harmonic drive/ball transfer subassemblies that can be configured in isolated (Module A) or open (Module B) configurations to achieve specific design and performance objectives.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A motor, comprising:

a housing;

a piston/harmonic drive assembly disposed within the housing a rotor assembly, wherein the piston/harmonic drive assembly comprises a piston and a harmonic drive;

a liner disposed between the piston/harmonic drive assembly and the rotor; and a valve assembly fluidly coupled to the housing;

wherein fluid provided from the rotor assembly to the valve assembly axially drives the piston/harmonic drive assembly over the liner; and wherein axially driving the piston/harmonic drive assembly over the liner imparts rotation to the rotor assembly.

2. The motor of claim 1, further comprising:

a ball transfer arrangement that converts axial motion of the piston/harmonic drive assembly into rotary motion.

3. The motor of claim 2, wherein the ball transfer arrangement comprises:

one or more ball transfers within the housing.

4. The motor of claim 1, wherein the piston is disposed between the harmonic drive and the valve assembly.

5. The motor of claim 1, wherein the harmonic drive is disposed between the piston and the valve assembly.

6. The motor of claim 1, further comprising:

a second valve assembly fluidly coupled to an opposite side of the piston;

wherein fluid provided from the rotor assembly to the second valve assembly axially drives the piston/harmonic drive assembly over the liner in an opposite axial direction; and wherein axially driving the piston/harmonic drive assembly over the liner in the opposite axial direction imparts rotation to the rotor assembly.

7. A drilling assembly, comprising:

a drill assembly housing;

a fluid driven motor assembly disposed within the drill assembly housing; and a drill bit attached to and rotationally driven by the fluid driven motor assembly;

wherein the fluid driven motor assembly comprises one or more fluid driven motors comprising:

a housing;

a piston/harmonic drive assembly disposed within the housing a rotor assembly, wherein the piston/harmonic drive assembly comprises a piston and a harmonic drive;

a liner disposed between the piston/harmonic drive assembly and the rotor; and a valve assembly fluidly coupled to the housing;

wherein fluid provided from the rotor assembly to the valve assembly axially drives the piston/harmonic drive assembly over the liner; and wherein axially driving the piston/harmonic drive assembly over the liner imparts rotation to the rotor assembly.

8. The drilling assembly of claim 7, wherein the fluid motor further comprises:

a ball transfer arrangement that converts axial motion of the piston/harmonic drive assembly into rotary motion.

9. The drilling assembly of claim 8, wherein the ball transfer arrangement comprises:

one or more ball transfers within the housing.

10. The drilling assembly of claim 7, wherein the piston is disposed between the harmonic drive and the valve assembly.

11. The drilling assembly of claim 7, wherein the harmonic drive is disposed between the piston and the valve assembly.

12. The drilling assembly of claim 7, wherein the fluid driven motor comprises two or more fluid driven motors.

13. The drilling assembly of claim 7, wherein at least one of the fluid motor further comprises:

a second valve assembly fluidly coupled to an opposite side of the piston;

wherein fluid provided from the rotor assembly to the second valve assembly axially drives the piston/harmonic drive assembly over the liner in an opposite axial direction; and wherein axially driving the piston/harmonic drive assembly over the liner in the opposite axial direction imparts rotation to the rotor assembly.

14. A method of powering a motor, comprising:

providing pressured fluid to a valve assembly of the motor;

porting the pressured fluid to a piston/harmonic drive assembly disposed around a rotor assembly at an initial position to drive the piston/harmonic drive assembly in a first axial direction in the housing;

rotating the rotor assembly by converting force from the axial movement into rotational force by axially driving the piston/harmonic drive assembly over a liner to impart rotation to the rotor assembly.

15. The method of claim 14, wherein the force is transferred by a ball transfer arrangement disposed within the motor.

16. The method of claim 14, further comprising:

providing pressurized fluid to a second valve assembly to axially drive the piston/harmonic drive assembly in an opposite axial direction.

17. The method of claim 14, further comprising passing the pressuring fluid over a harmonic drive portion of the piston/harmonic drive assembly.

18. The method of claim 14, wherein the rotor is coupled to a drill bit to rotate the drill bit.

19. A method of powering a motor assembly, comprising:

providing pressurized fluid to one or more fluid motor modules;

wherein the one or more fluid motor modules are powered by:

providing pressured fluid to valve assemblies of the one or more fluid motor modules;

porting the pressured fluid to piston/harmonic drive assemblies disposed around a rotor assembly to drive the piston/harmonic drive assemblies in an axial direction; and rotating the rotor assembly by converting force from the axial movement into rotational force by axially driving the piston/harmonic drive assembly over a liner.

20. The method of claim 19, wherein the force is transferred by ball transfer arrangements disposed within the one or more fluid motor modules.

* * * * *